US009415560B2

(12) United States Patent
Morinaga et al.

(10) Patent No.: US 9,415,560 B2
(45) Date of Patent: Aug. 16, 2016

(54) SHEET PROCESSING APPARATUS, IMAGE FORMING SYSTEM, AND IMAGE FORMING APPARATUS

(71) Applicants: Takuya Morinaga, Tokyo (JP); Nobuyoshi Suzuki, Tokyo (JP); Katsuhiro Kosuge, Kanagawa (JP); Yuusuke Shibasaki, Kanagawa (JP); Ryuji Yoshida, Kanagawa (JP); Wataru Takahashi, Toyko (JP); Takashi Saito, Kanagawa (JP); Akihiro Musha, Kanagawa (JP); Ikuhisa Okamoto, Kanagawa (JP); Shingo Matsushita, Tokyo (JP)

(72) Inventors: Takuya Morinaga, Tokyo (JP); Nobuyoshi Suzuki, Tokyo (JP); Katsuhiro Kosuge, Kanagawa (JP); Yuusuke Shibasaki, Kanagawa (JP); Ryuji Yoshida, Kanagawa (JP); Wataru Takahashi, Toyko (JP); Takashi Saito, Kanagawa (JP); Akihiro Musha, Kanagawa (JP); Ikuhisa Okamoto, Kanagawa (JP); Shingo Matsushita, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/302,971
(22) Filed: Jun. 12, 2014
(65) Prior Publication Data

US 2015/0003938 A1 Jan. 1, 2015

(30) Foreign Application Priority Data

Jul. 1, 2013 (JP) ..... 2013-138173

(51) Int. Cl.
*B31F 5/02* (2006.01)
*B42C 13/00* (2006.01)

(Continued)

(52) U.S. Cl.
CPC ... *B31F 5/02* (2013.01); *B31F 1/07* (2013.01); *B42B 4/00* (2013.01); *B42C 13/00* (2013.01);

(Continued)

(58) Field of Classification Search
CPC ..... B42F 3/003; B41F 5/02; B41F 1/07; B41F 2201/0712; B65H 39/06; B65H 2301/51616; G03G 15/6544
USPC ..... 270/52.18, 58.07, 58.08; 399/407, 408
See application file for complete search history.

(56) References Cited

U.S. PATENT DOCUMENTS 6,145,825 A * 11/2000 Kunihiro ..... B42C 1/12 227/29
7,077,395 B2 7/2006 Ata et al.

(Continued)

FOREIGN PATENT DOCUMENTS

CN 1460597 A 12/2003
CN 1872645 A 12/2006

(Continued)

OTHER PUBLICATIONS

Office Action for corresponding Chinese application No. 201410445398.X dated Feb. 2, 2016 and English Translation thereof.

*Primary Examiner* — Leslie A Nicholson, III
(74) *Attorney, Agent, or Firm* — Harness, Dickey & Pierce, P.L.C.

(57) ABSTRACT

A sheet processing apparatus includes: a sheet fastening unit of a pressing fastener method in which a bundle of sheets is fastened by using a pair of pressing fastener members; a conveying unit that conveys the bundle of sheets that are fastened by the sheet fastening unit; a separating unit that, after the sheet fastening unit performs a fastening operation on the bundle of sheets, moves both one and the other pressing fastener members, between which the bundle of sheets is interposed, so as to separate a sheet that adheres to the pressing fastener member; and a control unit that, after the separating unit finishes an operation to separate the sheet, controls the conveying unit so as to convey the bundle of sheets that are fastened by the sheet fastening unit.

20 Claims, 26 Drawing Sheets

(51) Int. Cl.

| | |
|---|---|
| ***B65H 39/06*** | (2006.01) |
| ***B42F 3/00*** | (2006.01) |
| ***B31F 1/07*** | (2006.01) |
| ***B42B 4/00*** | (2006.01) |
| ***B65H 37/04*** | (2006.01) |
| ***G03G 15/00*** | (2006.01) |

(52) U.S. Cl.

CPC ..... *B42F 3/003* (2013.01); *B65H 37/04* (2013.01); *B65H 39/06* (2013.01); *G03G 15/6538* (2013.01); *G03G 15/6544* (2013.01); *B31F 2201/0712* (2013.01); *B65H 2301/51616* (2013.01); *B65H 2601/255* (2013.01); *B65H 2601/2532* (2013.01); *B65H 2801/27* (2013.01); *G03G 2215/00843* (2013.01)

(56) References Cited

U.S. PATENT DOCUMENTS

| | | | | |
|---|---|---|---|---|
| 7,726,648 | B2 | 6/2010 | Tamura et al. | |
| 7,747,212 | B2 | 6/2010 | Yamamoto | |
| 8,123,209 | B2 * | 2/2012 | Kubota | B42C 1/12 270/58.07 |
| 8,235,375 | B2 * | 8/2012 | Shiraishi | 270/58.09 |
| 8,246,033 | B2 * | 8/2012 | Sato | 270/58.09 |
| 8,262,075 | B2 * | 9/2012 | Shiraishi | 270/58.09 |
| 8,333,372 | B2 * | 12/2012 | Awaya et al. | 270/58.07 |
| 8,413,979 | B2 * | 4/2013 | Sato | 270/58.08 |
| 2010/0219576 | A1 | 9/2010 | Yamamoto | |
| 2011/0184889 | A1 | 7/2011 | Tokita et al. | |
| 2011/0220557 | A1 | 9/2011 | Sasaki et al. | |
| 2011/0222945 | A1 * | 9/2011 | Sato | 399/408 |
| 2011/0236158 | A1 * | 9/2011 | Shiraishi | 412/33 |
| 2012/0083400 | A1 | 4/2012 | Shibasaki et al. | |
| 2012/0131885 | A1 | 5/2012 | Matsushita et al. | |
| 2012/0153556 | A1 | 6/2012 | Sugiyama et al. | |
| 2012/0229551 | A1 | 9/2012 | Watanabe et al. | |
| 2012/0282004 | A1 | 11/2012 | Furuhashi et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0154178 | A1 | 6/2013 | Suzuki et al. | |
| 2013/0215481 | A1 | 8/2013 | Hayasaka et al. | |
| 2013/0242359 | A1 | 9/2013 | Heishi et al. | |
| 2013/0264762 | A1 | 10/2013 | Matsushita et al. | |
| 2013/0270762 | A1 | 10/2013 | Saito et al. | |
| 2013/0300050 | A1 | 11/2013 | Suzuki et al. | |
| 2013/0320611 | A1 | 12/2013 | Kubo et al. | |
| 2014/0084531 | A1 | 3/2014 | Fukumoto et al. | |
| 2014/0138896 | A1 | 5/2014 | Yoshida et al. | |

FOREIGN PATENT DOCUMENTS

| | | |
|---|---|---|
| CN | 101234713 A | 8/2008 |
| JP | 2010-274623 | 12/2010 |
| JP | 2011-201698 | 10/2011 |
| JP | 2011-219236 | 11/2011 |
| JP | 2013-180883 | 9/2013 |

* cited by examiner

SHEET PROCESSING APPARATUS, IMAGE FORMING SYSTEM, AND IMAGE FORMING APPARATUS

CROSS-REFERENCE TO RELATED APPLICATIONS

The present application claims priority to and incorporates by reference the entire contents of Japanese Patent Application No. 2013-138173 filed in Japan on Jul. 1, 2013.

BACKGROUND OF THE INVENTION

1. Field of the Invention

The present invention relates to a sheet processing apparatus that processes a sheet, such as a sheet of paper, to an image forming apparatus that includes the sheet processing apparatus, and to an image forming system.

2. Description of the Related Art

A conventionally-known image forming system includes a sheet processing apparatus in which a sheet fastening apparatus is provided to perform an operation to fasten a bundle of sheets that have images formed by an image forming apparatus.

In a sheet processing apparatus disclosed in Japanese Patent Application Laid-open No. 2010-274623, a sheet fastening apparatus that has a pressing fastener system is provided to fasten a bundle of sheets, without using metallic staples, by strongly nipping the bundle of sheets by using a pair of pressing fastener teeth that are pressing fastener members that have concavity and convexity so that the fibers of the sheets are tangled and the sheets are pressed to be fastened. Pressure fastening, i.e., fastening a bundle of sheets without using metallic staples, can eliminate the trouble in removing the metallic staples from the bundle of sheets when the bundle of sheets is disposed of or is put into a shredder.

In the sheet processing apparatus disclosed in Japanese Patent Application Laid-open No. 2010-274623, after an image is formed on a bundle of sheets, the bundle of sheets is conveyed into a gap between one of the pressing fastener teeth and the other one of the pressing fastener teeth in the sheet fastening apparatus. Next, the one of the pressing fastener teeth is moved toward the bundle of sheets so that the bundle of sheets is pressed by the pair of pressing fastener teeth and the bundle of sheets is fastened. Then, after the one of the pressing fastener teeth is moved in a direction away from the bundle of sheets, the bundle of sheets is conveyed toward a discharge tray and is discharged onto the discharge tray.

However, a large pressing force is required to strongly nip a bundle of sheets by using a pair of pressing fastener teeth that has concavity and convexity. Therefore, a problem occurs in that, after a bundle of sheets is fastened by pressure, the bundle of sheets adheres to the one of the pair of pressing fastener teeth that does not move in a direction away from the bundle of sheets after the fastening operation is performed. If the bundle of sheets is conveyed toward the discharge tray while the sheet adheres to the pressing fastener tooth, there is a possibility that a problem occurs, such as a conveyance failure or damage to the sheet.

In consideration of the above, there is a need to provide a sheet processing apparatus, an image forming system that includes the sheet processing apparatus, and an image forming apparatus that make it possible to prevent a conveyance failure or damage to a sheet.

SUMMARY OF THE INVENTION

It is an object of the present invention to at least partially solve the problems in the conventional technology.

A sheet processing apparatus includes: a sheet fastening unit of a pressing fastener method in which a bundle of sheets is fastened by using a pair of pressing fastener members; a conveying unit that conveys the bundle of sheets that are fastened by the sheet fastening unit; a separating unit that, after the sheet fastening unit performs a fastening operation on the bundle of sheets, moves bothe one and the other pressing fastener members, between which the bundle of sheets is interposed, so as to separate a sheet that adheres to the pressing fastener member; and a control unit that, after the separating unit finishes an operation to separate the sheet, controls the conveying unit so as to convey the bundle of sheets that are fastened by the sheet fastening unit.

An image forming system includes: an image forming apparatus that forms an image on a sheet; and a sheet processing unit that processes a sheet that has an image formed by the image forming apparatus. The sheet processing unit is as described above.

An image forming apparatus forms an image on a sheet. The image forming apparatus comprising a sheet processing apparatus as described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An explanation is given below of an embodiment of the present invention with reference to the drawings.

Figure 1B:
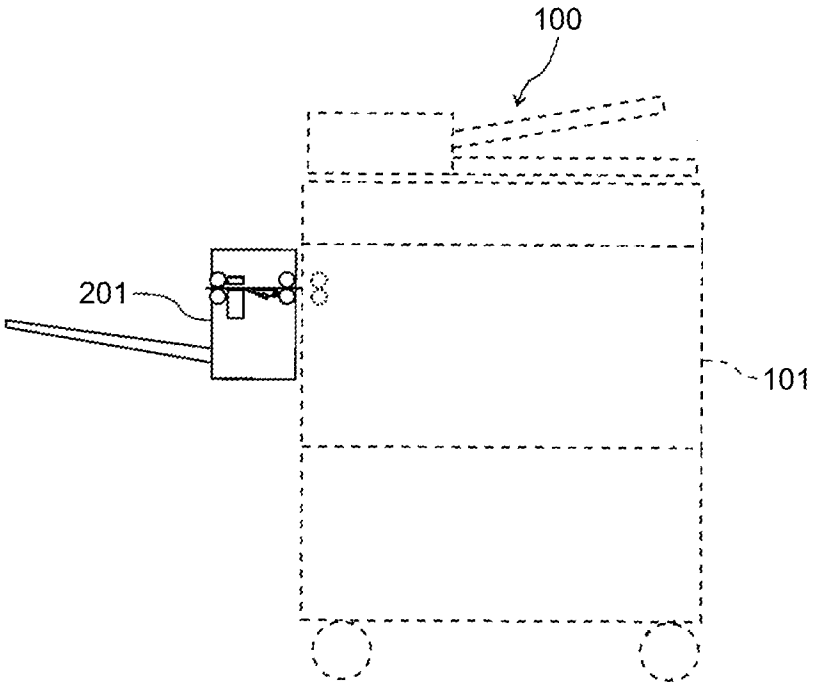
FIGS. 1A and 1B are schematic configuration diagrams that illustrate an example of the overall configuration of an image forming system according to an embodiment of the present invention.
Figure 1A:
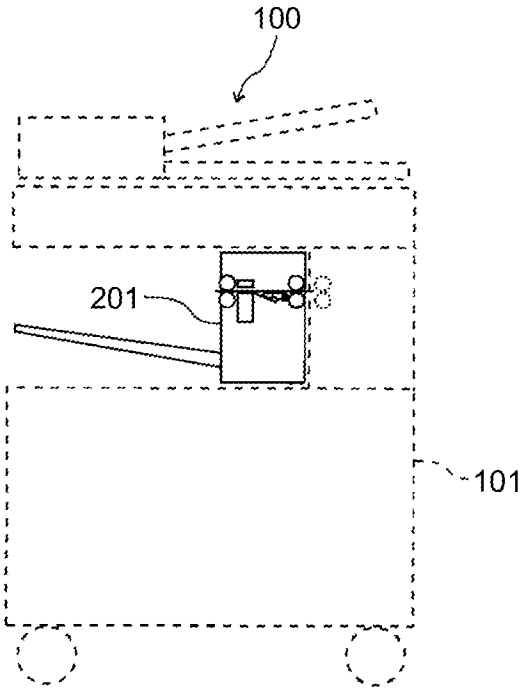

FIGS. 1A and 1B are schematic configuration diagrams that illustrate an example of the overall configuration of an image forming system according to an embodiment of the present invention. An image forming system 100 of FIG. 1A has an exemplary configuration where a sheet processing apparatus (referred to as the "sheet post-processing apparatus" below) 201 that is a sheet processing apparatus is installed in an image forming apparatus 101 that is an image forming unit that forms an image on a sheet that is a sheet on the basis of an input image. Furthermore, the image forming system 100 of FIG. 1B has an exemplary configuration where the sheet post-processing apparatus 201 is connected to the image forming apparatus 101.

The image forming apparatus 101 of the present embodiment forms, on a sheet, images including toner images by using an electrophotographic system; however, it may form images by using other systems, such as an ink-jet system. Furthermore, according to the present embodiment, an explanation is given of the image forming system in which the image forming apparatus 101 and the sheet post-processing apparatus 201 are combined; however, the present invention can be applied to the image forming apparatus 101 that has the built-in sheet post-processing apparatus 201.

Furthermore, the present invention is applicable even if the sheet post-processing apparatus 201 is configured as a sheet processing apparatus that is separated from the image forming apparatus 101. In this case, the sheet processing apparatus may be provided with a cassette or a tray on which a sheet to be fastened is placed, a tray to which a bundle of sheets is output after a fastening operation is performed, or the like.

Figure 2:
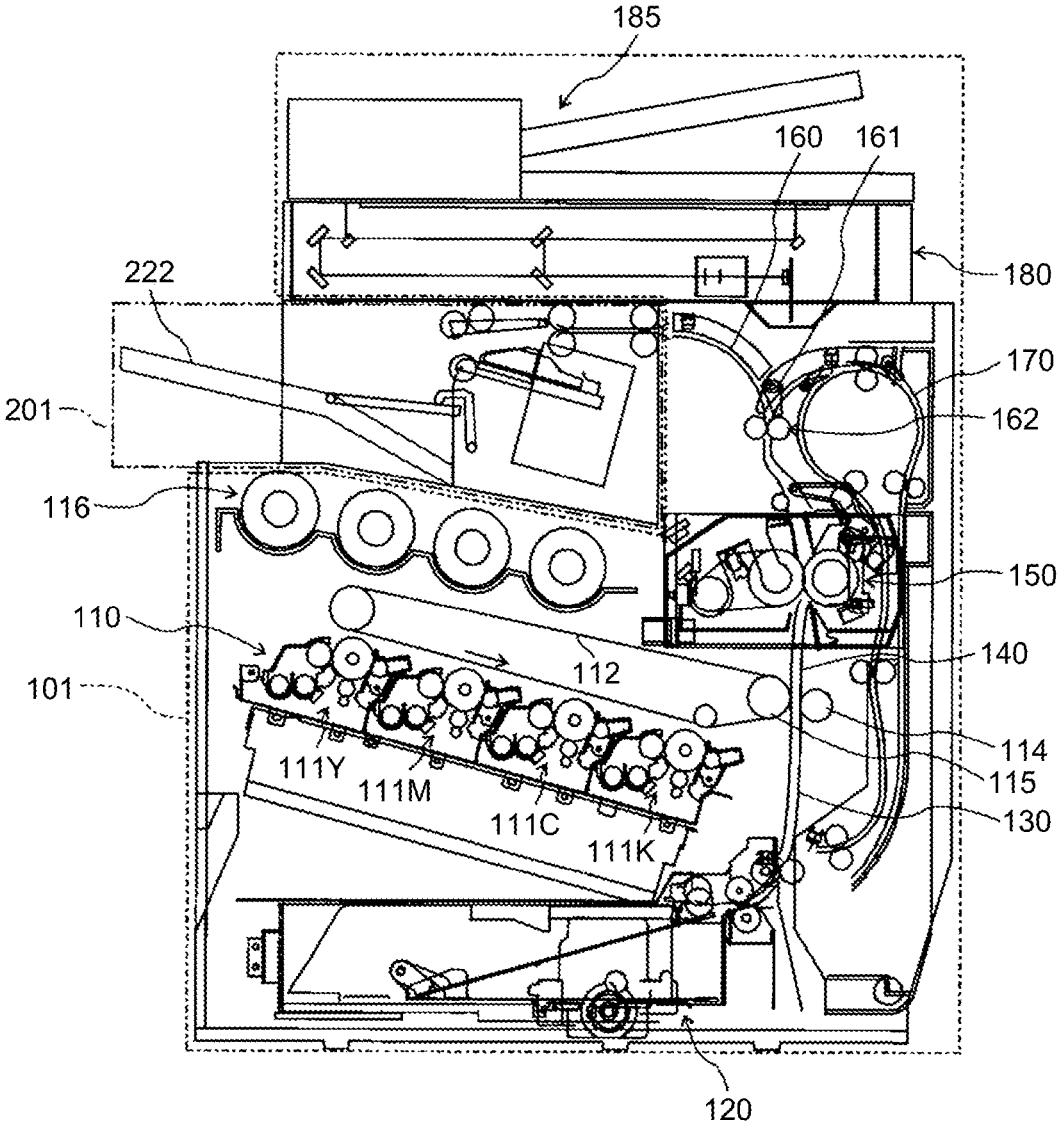
FIG. 2 is a schematic configuration diagram that illustrates an exemplary configuration of an image forming apparatus of the image forming system according to the present embodiment.

FIG. 2 is a schematic configuration diagram that illustrates an exemplary configuration of the image forming apparatus 101 of the image forming system 100 according to the present embodiment.

In FIG. 2, the image forming apparatus 101 is a tandem-type color image forming apparatus that has an indirect transfer system using an intermediate transfer member. An image forming unit 110 that is a toner-image forming unit is provided in substantially the middle section of the image forming apparatus 101. The image forming unit 110 includes image forming stations 111Y, 111M, 111C, and 111K of four colors (Y: yellow, M: magenta, C: cyan, and K: black) (the attached characters Y, M, C, and K are omitted below as appropriate) that are provided such that they are arranged in a predetermined direction.

The image forming apparatus 101 further includes a feeding tray 120 that is a plurality of sheet feeding units that is a recording-medium feeding unit and that is provided under the image forming unit 110. It further includes a sheet-feeding conveyance path (vertical conveyance path) 130 that conveys a sheet to a secondary transfer unit 140 and a fixing unit 150, the sheet being a recoding medium picked up by the feeding tray 120. The image forming apparatus 101 further includes a bifurcating sheet-discharge path 160 and a two-sided conveyance path 170, the bifurcating sheet-discharge path 160 conveys, toward the sheet post-processing apparatus 201, a sheet on which an image (toner image) is fixed, and the two-sided conveyance path 170 turns over the sheet that has an image formed on a first surface (front surface) thereof so that an image is formed on a second surface (back surface) thereof.

The image forming apparatus 101 further includes a scanner unit 180 that is an image read unit and includes an automatic document feeder (ADF) 185 that is original-document feed unit. The scanner unit 180 reads an image of an original document and converts it into an electric signal, the original document being an image read object that is placed on a glass surface that is a platen. Furthermore, one or more original documents are placed on the automatic document feeder (ADF) 185 so that an image thereof is read by the scanner unit 180, and each of the original documents is conveyed to the glass surface at the read position of the scanner unit 180.

The image forming unit 110 includes photosensitive drums that are the image carriers for the colors Y, M, C, and K of the image forming stations 111. A charge unit that is a charging unit, a development unit that is a developing unit, a primary transfer unit, a cleaning unit, a neutralization unit that is a neutralizing unit are provided around each of the photosensitive drums along its outer periphery. Furthermore, the image forming unit 110 includes an undepicted optical writing unit that is a light irradiation unit and includes an intermediate transfer belt 112 that is an intermediate transfer member. The optical writing unit is provided under each of the image forming stations 111, and it forms an electrostatic latent image by emitting light to each of the photosensitive drums on the basis of image data that is generated by using the reading result of the scanner unit 180 for each of the colors. The intermediate transfer belt 112 is provided above the image forming stations 111, and the image (toner image) formed on each of the photosensitive drums is transferred by the primary transfer unit.

The intermediate transfer belt 112 is rotatably supported by a plurality of supporting rollers. A supporting roller 114, which is one of the supporting rollers, is opposed to a secondary transfer roller 115 through the intermediate transfer belt 112 in the secondary transfer unit 140. In the secondary transfer unit 140, the image (toner image) on the intermediate transfer belt 112 is secondarily transferred onto a sheet. A replaceable toner container 116 is provided above the intermediate transfer belt 112.

The image forming process of the image forming apparatus (tandem-type color image forming apparatus that has an indirect transfer system) that has the above-described configuration is well-known, and it is not directly related to the scope of the present invention; therefore, a detailed explanation is omitted.

The fixing-finished sheet on which a fixing operation has been performed by the fixing unit 150 is conveyed by a conveyance roller 162, and its conveying direction is switched by a conveyance-path switch member 161. Thus, the fixing-finished sheet is conveyed to the bifurcating sheet-discharge path 160 or the two-sided conveyance path 170.

To perform post processing on a plurality of sheets including a sheet on which an image has been formed, the sheet post-processing apparatus 201 of the present embodiment includes a conveyance-path fastening mechanism that is a sheet fastening unit that fastens a bundle of sheets that includes a plurality of sheets, i.e., a bundle of sheets. The conveyance-path fastening mechanism includes a configuration for stacking and aligning sheets within a sheet conveyance path and includes a fastener that is a fastening unit that fastens the stacked sheets.

Figure 3:
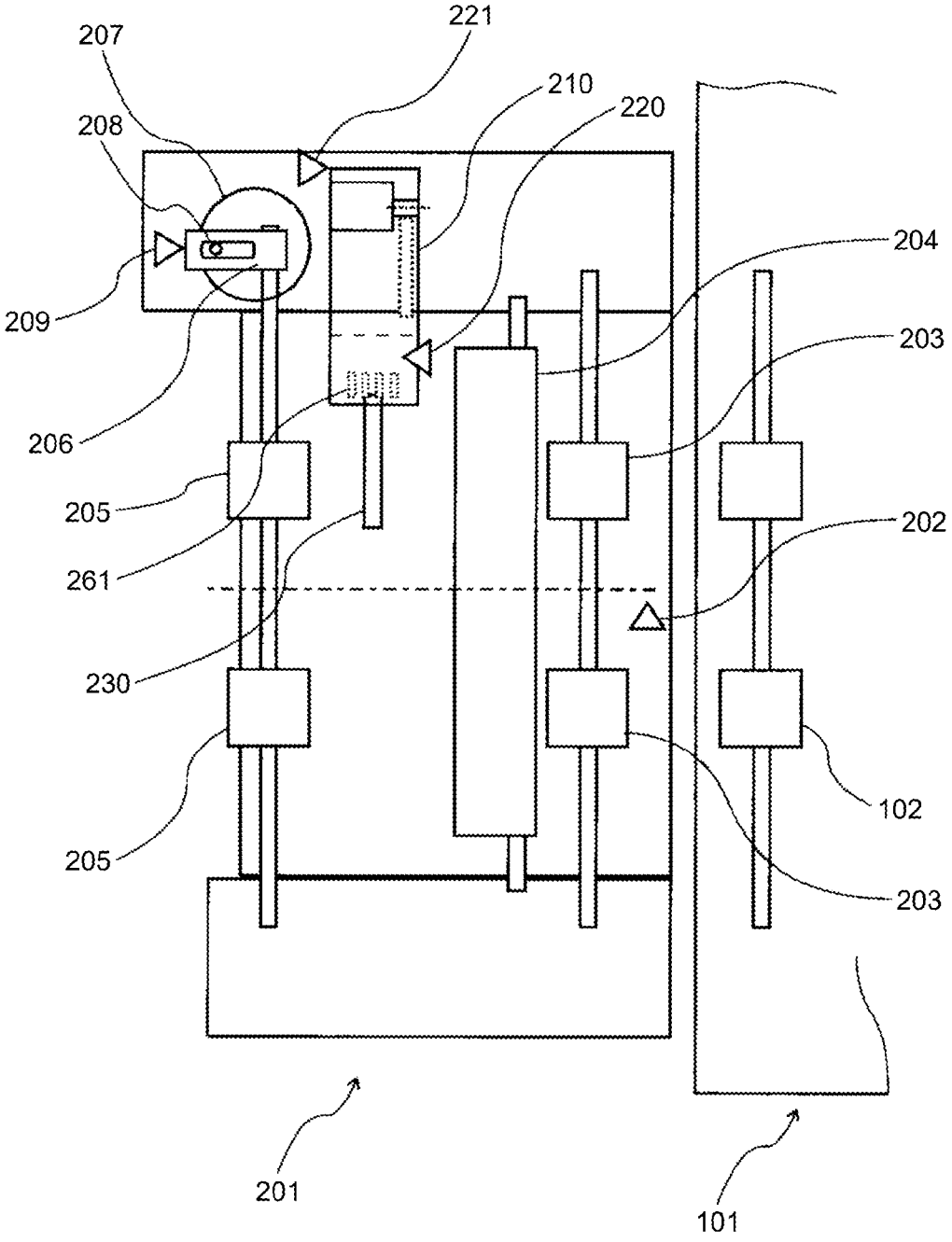
FIG. 3 is a plan view that illustrates an exemplary configuration of a sheet post-processing apparatus of the image forming system according to the present embodiment.
Figure 4:
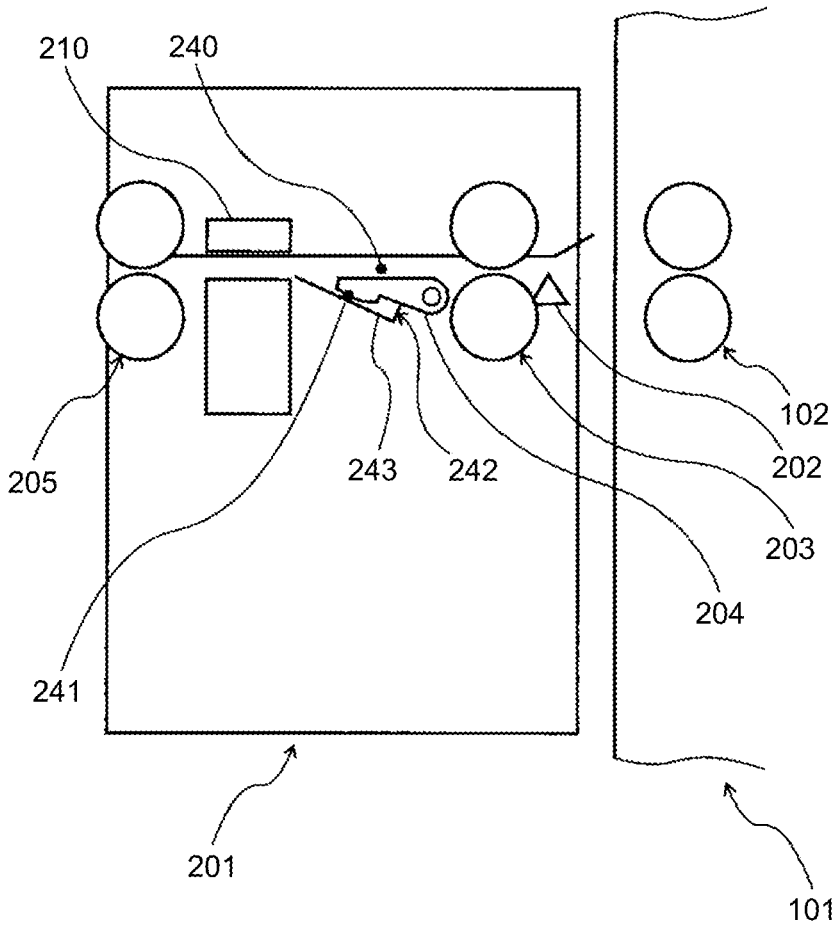
FIG. 4 is a front view of the sheet post-processing apparatus.

FIG. 3 and FIG. 4 are a plan view and a front view that illustrate an exemplary configuration of the sheet post-processing apparatus 201 that includes the conveyance-path fastening mechanism that is included in the image forming system 100 according to the present embodiment.

The sheet post-processing apparatus 201 includes an entry sensor 202, entry rollers 203, a bifurcating claw (switch claw) 204, sheet discharge rollers 205, a shift link 206, a shift cam 207, a shift cam stud 208, a shift home-position sensor 209, and a fastener 210.

The entry sensor 202 detects the presence or absence of the leading edge and the trailing edge of a sheet that is delivered to the sheet post-processing apparatus 201 through a sheet discharge roller 102 of the image forming apparatus 101.

The entry rollers 203 are located on the entry of the sheet post-processing apparatus 201, and it has the capability to convey a sheet to the sheet post-processing apparatus 201. By using the roller nip of the entry rollers 203, it is possible to bring a sheet into contact with it for skew correction. The entry rollers 203 are driven by an undepicted driving source that can be controlled. The driving source is controlled by a control unit that is described later, whereby the entry rollers 203 are controlled so as to be driven to rotate and be stopped by the driving source, and the distance over which a sheet is conveyed by the entry rollers 203 is controlled. The control unit may be provided in the image forming apparatus 101.

The bifurcating claw 204 is a rotatable claw that switches a conveyance path that is provided to guide the trailing edge of a sheet to a bifurcating path 241. Furthermore, the bifurcating claw 204 is configured to press the sheet against the conveyance surface of the bifurcating path, and the sheet can be fixed by using the pressure.

The sheet discharge rollers 205 are located on the outlet of the sheet post-processing apparatus 201, and it has the capability to convey, shift, and discharge a sheet. Furthermore, the sheet discharge rollers 205 are driven by an undepicted driving source that can be controlled. The driving source is controlled by a control unit that is described later, whereby the sheet discharge rollers 205 are controlled so as to be driven to rotate and be stopped by the driving source, and the distance over which a sheet is conveyed by the sheet discharge rollers 205 is controlled.

A conveying unit that conveys a sheet in the sheet post-processing apparatus 201 according to the present embodiment is constituted by, for example, the entry rollers 203, the sheet discharge rollers 205, and the driving sources that drive them.

The shift link 206 is provided on the end of the shaft of the sheet discharge rollers 205, and it is a section that receives the moving force for shifting.

The shift cam 207 includes the shift cam stud 208, and it is a disk-shaped component that rotates. The rotation of the component shifts the sheet discharge rollers 205 that are connected to an elongated hole section of the shift link 206 via the shift cam stud 208.

The shift cam stud 208 operates in conjunction with the elongate hole section of the shift link 206 to change the rotary movement of the shift cam 207 into a linear movement in the axial direction of the sheet discharge rollers 205.

The shift home-position sensor 209 detects the position of the shift link 206 and determines that the detected position is the home position (stand-by position).

The fastener 210 is a tool or device that fastens a bundle of sheets by squeezing, pressing, and fastening processing without using metallic staples. According to the present embodiment, the fastener 210 is used to nip a bundle of sheets by using a single pair of teeth that have concavity and convexity on their surfaces so that the sheets are deformed and the fibers thereof are tangled. For example, the well-known fastener that is disclosed in Japanese Examined Utility Model Application Publication No. 36-013206 can be used as the above type of fastener 210. Furthermore, a U-shaped cut is formed in a bundle of sheets and the portion is bent, a slit is simultaneously formed near the bent portion, and the end of the cut and bent portion is passed through the slit so as to be prevented from being released from it, whereby it is possible to use a fastener that fastens a bundle of sheets without using metallic staples (e.g., see Japanese Examined Utility Model Application Publication No. 37-007208). A fastening unit that fastens a bundle of sheets is not limited to the fastener of the present embodiment, and it may be appropriate if it has a capability to fasten sheets by squeezing, pressing, and fastening processing, i.e., fastening sheets by applying pressure so that the fibers of the sheets are tangled.

A sheet edge sensor 220 is a sheet-edge detection unit and is a sensor that detects the side edge of a sheet. When a sheet is aligned, the detection position that is detected by the sensor is used as a reference for aligning sheets.

A fastener home-position sensor 221 is a sensor that detects the position of the fastener 210 that is movable in a width direction that intersects with the conveying direction of a sheet. The home position (stand-by position) is where the fastener 210 is located at a position so as not to interfere with a conveyed sheet of the maximum size, and the position is detected by the fastener home-position sensor 221.

A fastener-movement guide rail 230 is a rail that guides a movement of the fastener 210 so that the fastener 210 can move in a width direction of a sheet in a stable manner.

A conveyance path 240 is a normal pathway for conveying and discharging the received sheet. The bifurcating path 241 is provided to stack and align sheets, and it is the conveyance path to which a sheet is conveyed starting from the trailing edge side thereof due to a switchback of the sheet.

A contact surface 242 is a reference surface for bringing the trailing edges of sheets into contact with it and aligning the sheets on a fastening-operation tray (staple tray) 243 that is a sheet containing section that contains sheets that are to be fastened. For example, according to the present embodiment, teeth 261 are the teeth that are configured such that a single pair of concavity and convexity is engaged, and sheets are nipped so that the sheets are deformed and the fibers thereof are tangled.

Figure 5:
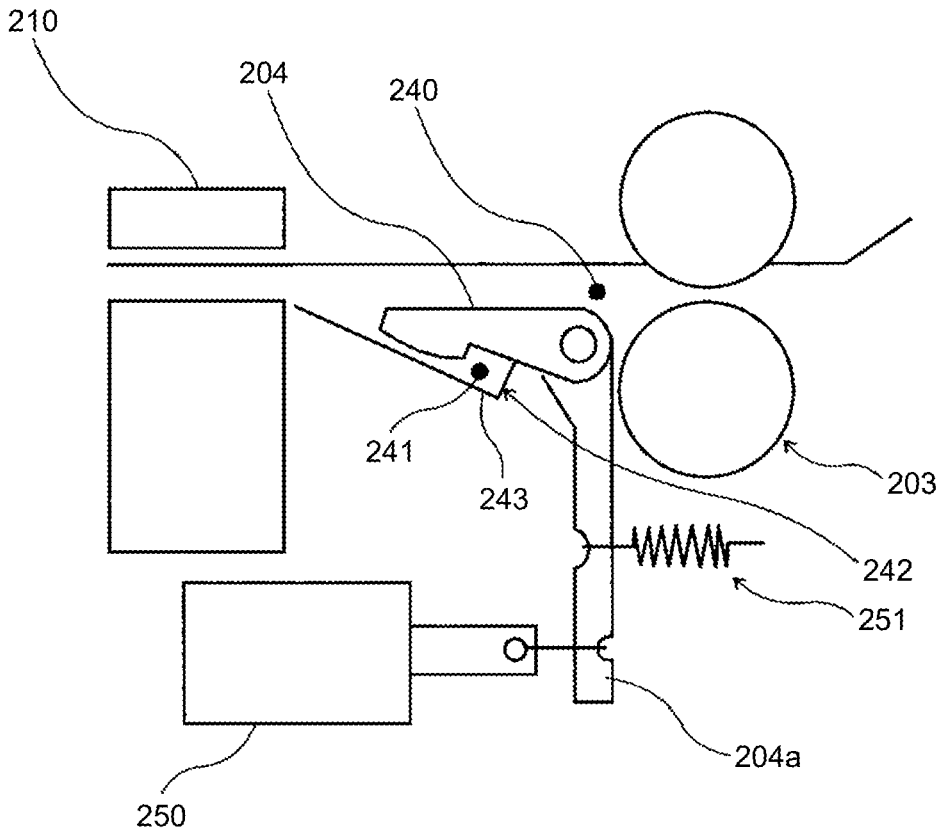
FIG. 5 is an explanatory diagram that illustrates the home position of a bifurcating claw that switches a path of a sheet that is received by the sheet post-processing apparatus.
Figure 6:
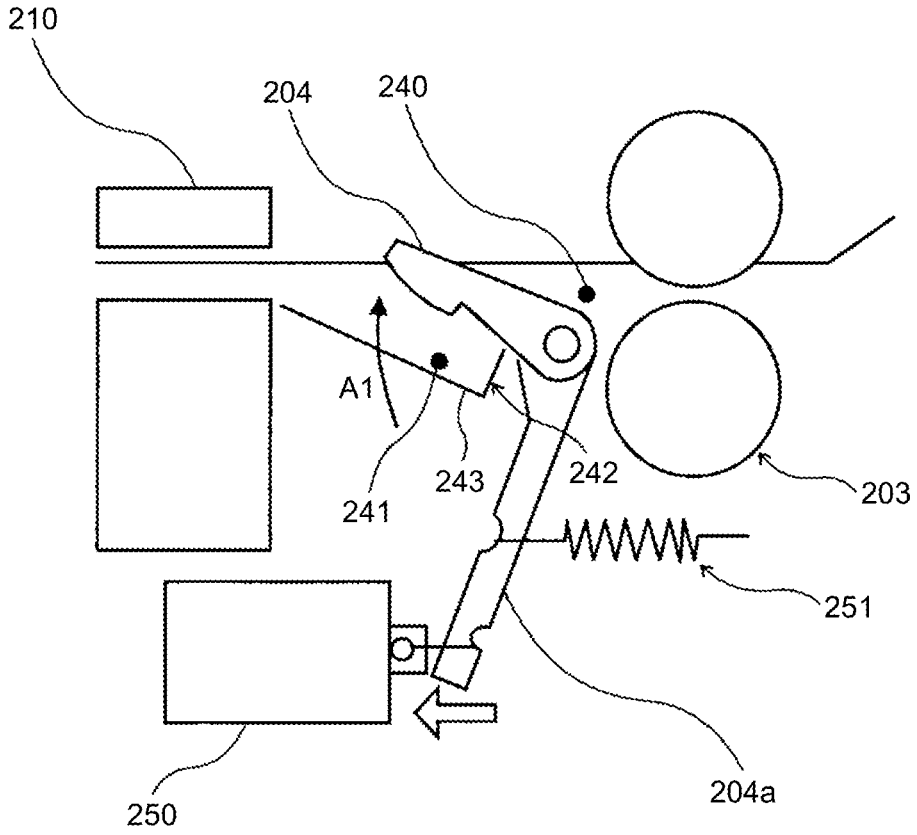
FIG. 6 is an explanatory diagram that illustrates the position of the bifurcating claw when the sheet received by the sheet post-processing apparatus is switch to a bifurcating path.

FIGS. 5 and 6 are explanatory diagrams that illustrate a detailed exemplary configuration of the bifurcating claw 204 that switches a path of a sheet received by the sheet post-processing apparatus 201 and the periphery thereof. FIG. 5 is an explanatory diagram that illustrates the home position of the bifurcating claw 204. Furthermore, FIG. 6 is an explanatory diagram that illustrates the position of the bifurcating claw when the path of a sheet received by the sheet post-processing apparatus 201 is switched to the bifurcating path 241.

The bifurcating claw 204 is configured to rotate so as to switch the conveyance path 240 and the bifurcating path 241. As illustrated in FIG. 5, the home position of the bifurcating claw 204 is the rotation position where the sheet received from the right side in the drawing can be conveyed without any resistance. The bifurcating claw 204 is always pressed by a spring 251 as illustrated in FIG. 5. The spring 251 is engaged with a bifurcating-claw movable lever section 204*a*. The bifurcating-claw movable lever section 204*a* is also connected to a bifurcation solenoid 250 via a link. Furthermore, the conveyance surface of the bifurcating path 241 and the bifurcating claw 204 are configured to nip a sheet within the conveyance path. As for switching of the conveyance path, when the bifurcation solenoid 250 is turned on, the bifurcating claw 204 is rotated in the direction of the arrow A1 in FIG. 6 so that the conveyance path 240 is closed, and a sheet is guided into the bifurcating path 241.

According to the present embodiment, a unit that stacks a plurality of sheets, which are the objects to be fastened, to produce a bundle of sheets is constituted by the entry roller 203, the sheet discharge rollers 205, the bifurcating claw 204, the fastening-operation tray 243 including the contact surface 242, the driving sources for driving them, and the like.

Figure 7:
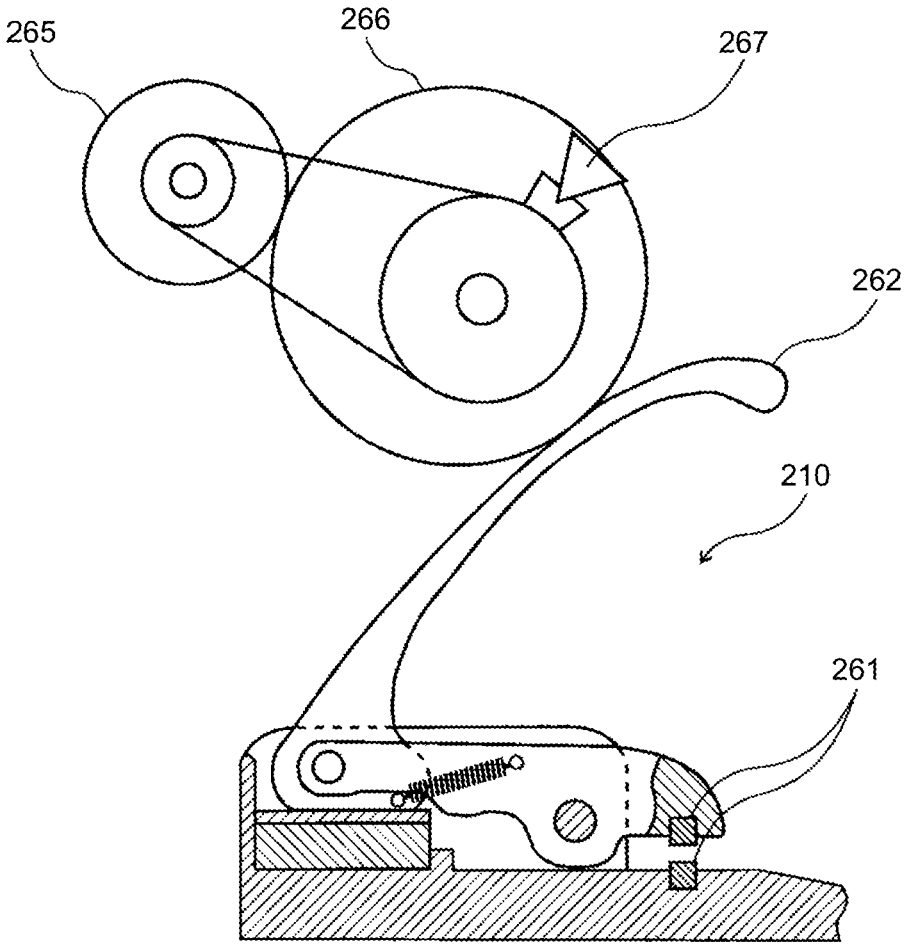
FIG. 7 is an explanatory diagram that illustrates an example of a fastener with teeth opened and a driving mechanism thereof.
Figure 8:
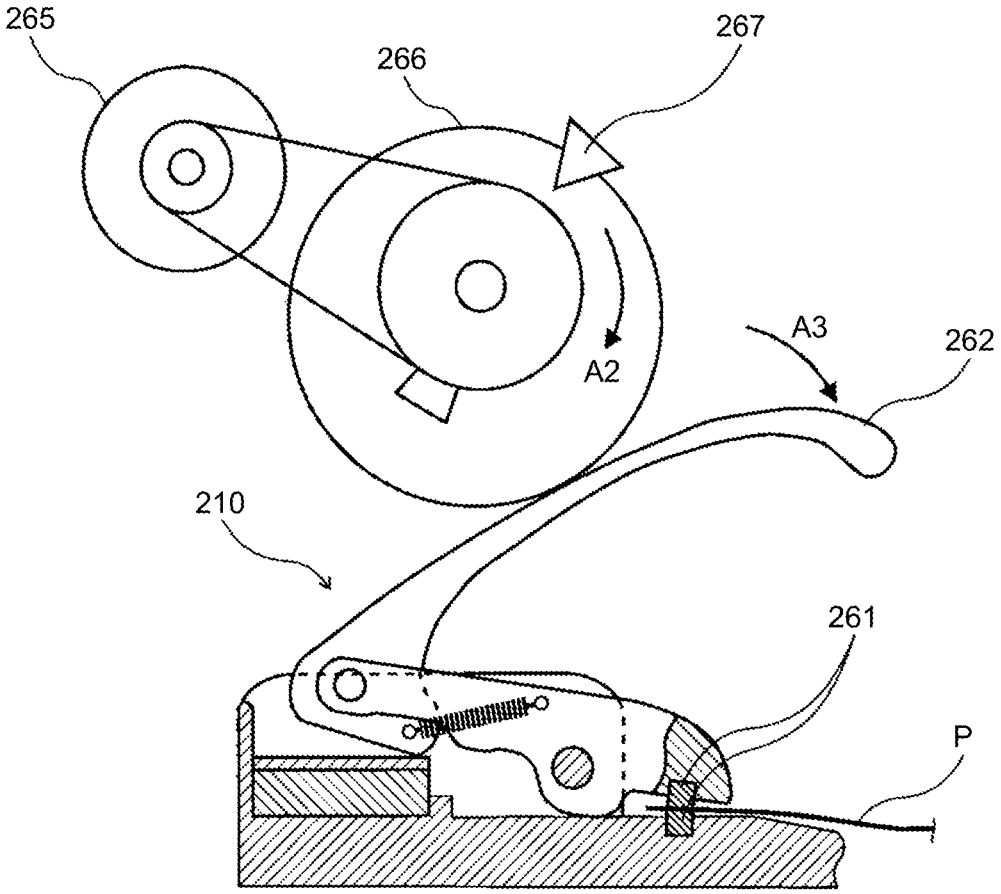
FIG. 8 is an explanatory diagram that illustrates an example of the fastener with the teeth closed and the driving mechanism thereof.

FIGS. 7 and 8 are explanatory diagrams that illustrate an example of the configuration and operation of the fastener 210. FIG. 7 is an explanatory diagram that illustrates an example of the fastener 210 with the teeth 261 opened and the driving mechanism thereof, and FIG. 8 is an explanatory diagram that illustrates an example of the fastener 210 with the teeth 261 closed and the driving mechanism thereof. The configuration of the fastener 210 is not limited to the configuration of FIGS. 7 and 8.

In FIG. 7, the teeth 261 are the pair of upper and lower teeth and are configured to engage with each other. The teeth 261 are provided on the end of a group of combined links and are configured to be in contact with or be away from each other due to the rotation of a pressing lever 262. The pressing lever 262 is rotated in the direction of the arrow A3 of FIG. 8 by a cam 266 that rotates in the direction of the arrow A2 of FIG. 8. The cam 266 is rotated due to the driving force applied from a drive motor 265, and it is controlled so as to be located in the detection position on the basis of the detection information of a cam home-position sensor 267. The detection position of the cam home-position sensor 267 is the home position (stand-by position) of the cam 266, and the teeth 261 are opened while in this position.

An operation is performed to fasten sheets as illustrated in FIG. 8. While the pair of the teeth 261 are opened, a sheet P is inserted into the gap therebetween, and the cam 266 is rotated in the direction of the arrow A2 of FIG. 8 in accordance with the rotation of the drive motor 265. Due to the displacement of the cam surface, the pressing lever 262 is rotated in the direction of the arrow A3 in the drawing. The rotative force is increased through the group of links by using the lever, and it is transmitted to the teeth 261 in the end. When the cam 266 is rotated for a certain degree, the teeth 261 are engaged with each other to nip the sheet P. Due to the nip, the sheet P is pressed and deformed, and the fibers of the adjacent sheets are tangled and joined. Afterward, the drive motor 265 is rotated in reverse and is stopped at the detection position of the cam home-position sensor 267. Furthermore, the pressing lever 262 has spring characteristics; therefore, it is bent when an overload is applied, whereby the overload is released.

In the fastener 210 that is configured as described above in FIGS. 7 and 8, the fastening force, i.e., the force with which the teeth 261 are engaged to nip the sheet P so as to press and deform it, is changed, and the fastening strength for fastening a bundle of sheets whose fibers are tangled is changed. The fastening force with which the teeth 261 are engaged is changed according to the rotative force (torque) during the rotation of the pressing lever 262 via the cam 266, i.e., the torque (moment of force) generated by the drive motor 265. The torque generated by the drive motor 265 is changed according to the motor current supplied to the drive motor 265. Therefore, by controlling the motor current supplied to the drive motor 265, the fastening force of the fastener 210 is changed according to a fastening mode, such as a proper fastening mode or a temporary fastening mode, whereby the fastening strength for a bundle of sheets can be changed.

Next, an explanation is given of an example of a fastening operation of the sheet post-processing apparatus 201.

FIGS. 9A to 17B are plan views and front views of the sheet post-processing apparatus 201 when the fastening operation is performed according to the present embodiment. Out of FIGS. 9A to 17B, FIGS. 9A, 10A, 11A, 12A, 13A, 14A, 15A, 16A, and 17A are plan views of the sheet post-processing apparatus 201, and FIGS. 9B, 10B, 11B, 12B, 13B, 14B, 15B, 16B, and 17B are front views of the sheet post-processing apparatus 201.

Figure 9A:
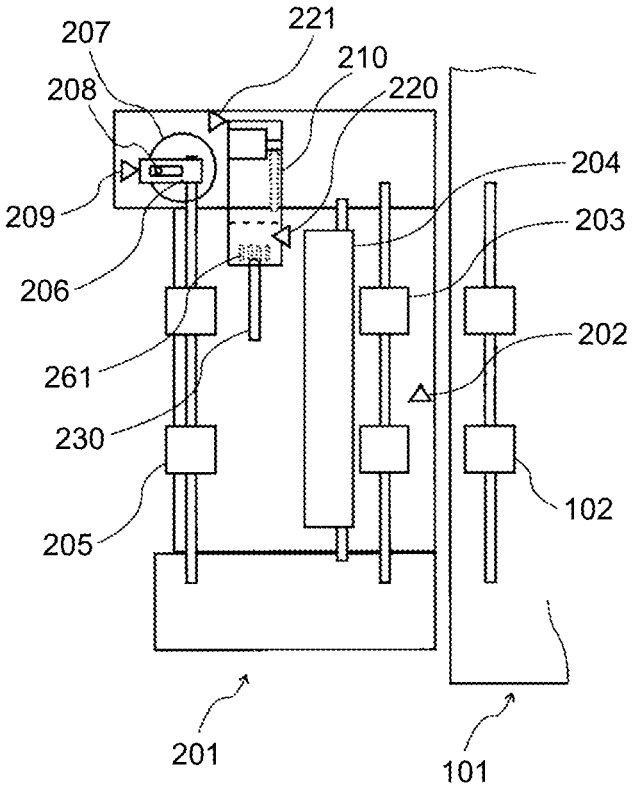
FIGS. 9A and 9B are a plan view and a front view that illustrate the internal state of the sheet post-processing apparatus after an initialization operation is completed.
Figure 9B:
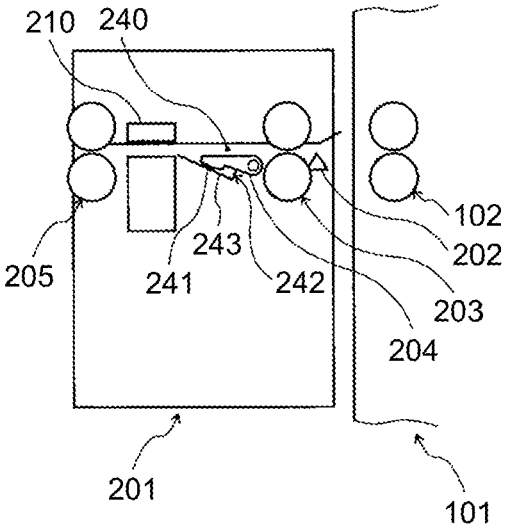

First, in FIGS. 9A and 9B, when the image forming apparatus 101 starts to output a sheet, each unit is moved to its home position, whereby an initialization operation is completed.

Figure 10A:
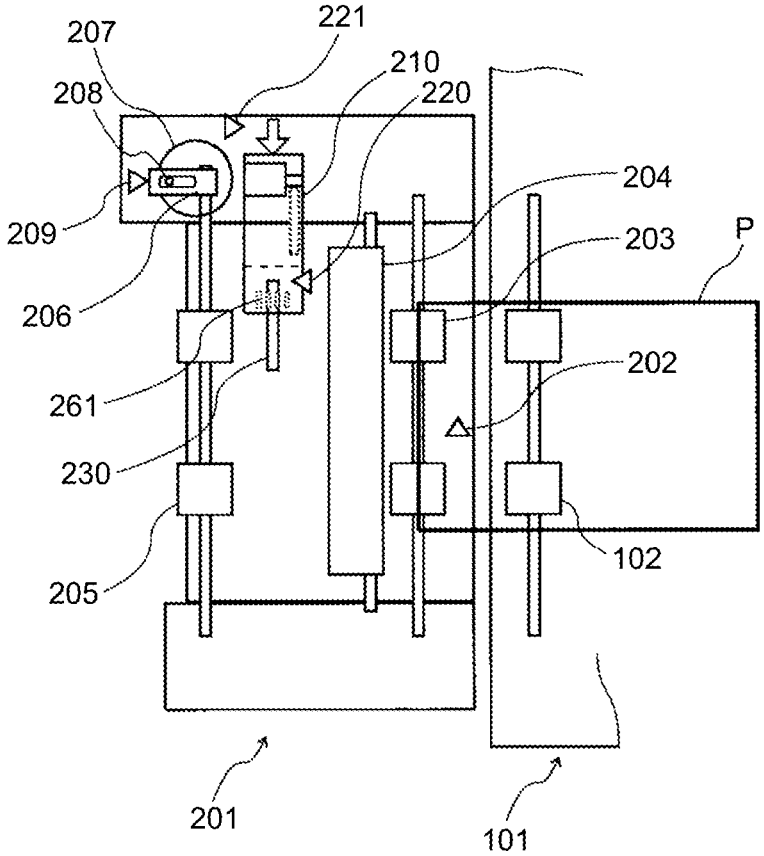
FIGS. 10A and 10B are a plan view and a front view that illustrate the internal state of the sheet post-processing apparatus when a sheet is received.
Figure 10B:
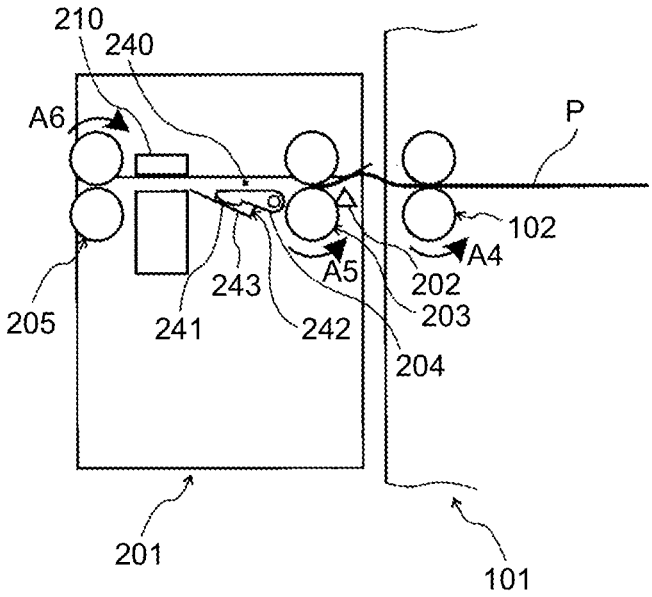

Next, in FIGS. 10A and 10B, before the sheet P output from the image forming apparatus 101 is conveyed to the sheet post-processing apparatus 201, the sheet post-processing apparatus 201 receives information on an operating mode and information on the sheet P and, in accordance with the pieces of information, it enters a receiving standby state. The operating modes according to the present embodiment include a straight mode, a shift mode, and a fastening mode; however, this is not a limitation.

While in a receiving standby state during a straight mode, the sheet discharge roller 102 of the image forming apparatus 101 is rotated in the direction of the arrow A4 in the drawing so that the sheet P discharged from the image forming apparatus 101 is sent to the sheet post-processing apparatus 201. In the sheet post-processing apparatus 201, each of the entry roller 203 and the sheet discharge roller 205 starts to rotate in a predetermined rotation direction (the direction A5 and the direction A6 in the drawing) so that the received sheet P is conveyed in a predetermined conveying direction (to the left in the drawing). The plurality of sheets P are sequentially conveyed and discharged and, when the final sheet is discharged, each of the rollers 203 and 205 is stopped.

While in a receiving standby state during a shift mode, first, each of the entry roller 203 and the sheet discharge roller 205 starts to rotate in a predetermined rotation direction so that the received sheet P is conveyed in a predetermined conveying direction (to the left in the drawing) in the same manner as in the straight mode. During a shift sheet discharge operation, the sheet P is received and conveyed and, when the trailing edge of the sheet P passes through the entry roller 203, the shift cam 207 is rotated for a certain degree so that the sheet discharge roller 205 is moved in the axial direction thereof. At this time, the sheet P is also moved in accordance with the movement of the sheet discharge roller 205. Furthermore, after the sheet P is discharged, the shift cam 207 is rotated to return to the home position and stands by for the subsequent sheet. This operation of the sheet discharge roller 205 is repeated until the sheets in the same "set" are discharged. If a sheet in the subsequent "set" is conveyed, the shift cam 207 is rotated in the rotation direction opposite to the previous direction so that the sheet is moved to the opposite side and is discharged.

While in a receiving standby state during a fastening mode, the entry roller 203 is stopped, and the sheet discharge roller 205 starts to rotate in the direction of the arrow A6 in the drawing so that the received sheet P is conveyed in a predetermined conveying direction (to the left in the drawing). Furthermore, the fastener 210 is moved to stand by at the stand-by position (home position) that is retracted from the end of the sheet P in a width direction by a certain distance.

Afterward, when the sheet P is conveyed to the sheet post-processing apparatus 201, the leading edge of the sheet P is detected by the entry sensor 202. After it is detected, the sheet P is conveyed for a certain distance (a distance such that the leading edge of the sheet P is brought into contact with the nip of the entry roller 203 and the sheet P is bent for a certain degree). After it is conveyed, the entry roller 203 starts to rotate. Thus, skew of the sheet P is corrected.

Figure 11A:
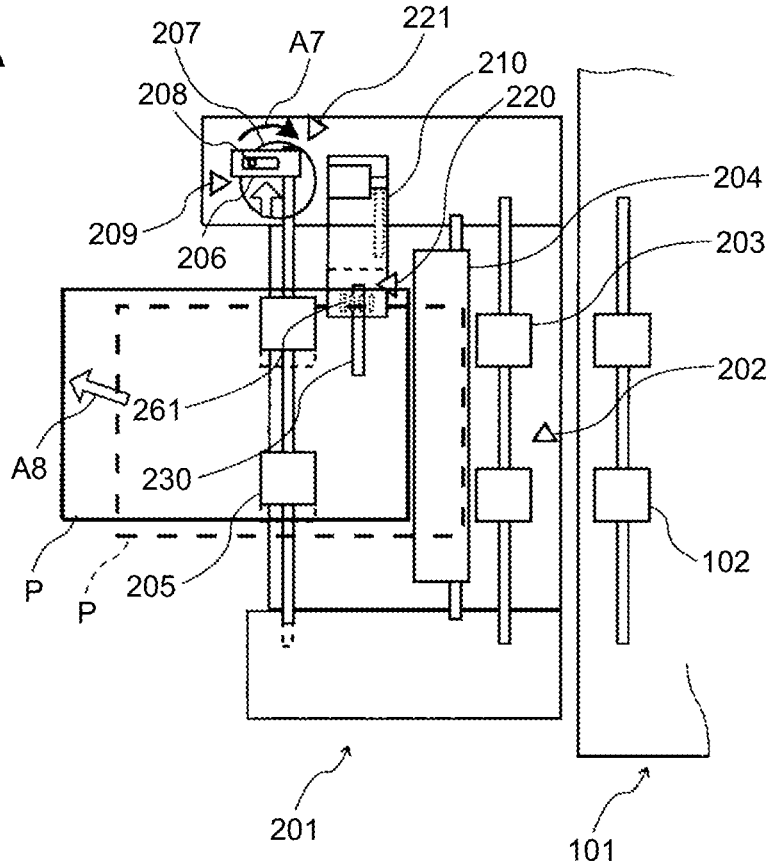
FIGS. 11A and 11B are a plan view and a front view that illustrate the internal state of the sheet post-processing apparatus when the position of a sheet is set in a width direction.
Figure 11B:
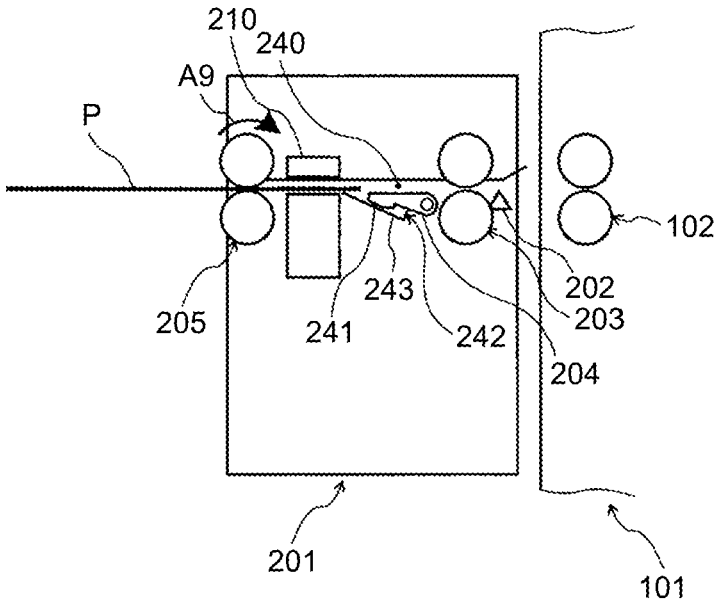

Next, in FIGS. 11A and 11B, the distance over which the sheet P is conveyed is counted by using, as a reference, the detection information of the entry sensor 202 that detects the trailing edge of the sheet P, and the positional information on the sheet P is determined. When the trailing edge of the sheet P passes through the nip of the entry roller 203, the entry roller 203 stops so as to receive the subsequent sheet. At the same time, the shift cam 207 is rotated in the direction (clockwise direction) of the arrow A7 of FIG. 11A, and the sheet discharge roller 205 starts to move in the axial direction thereof together with the sheet P. Then, the sheet P is conveyed at a tilt in the direction of the arrow A8 of FIG. 11A. Afterward, when the sheet edge sensor 220, which is provided together with or is installed in the fastener 210, detects the sheet P, the shift cam 207 is stopped and is then rotated in reverse. The reverse rotation of the shift cam 207 is stopped when the sheet edge sensor 220 enters a non-detection state. After the above-described operation is completed, the trailing edge of the sheet P passes through the leading edge of the bifurcating claw 204 and is located at a predetermined position, and the rotation of the sheet discharge roller 205 in the direction of the arrow A9 in the drawing is stopped.

Figure 12A:
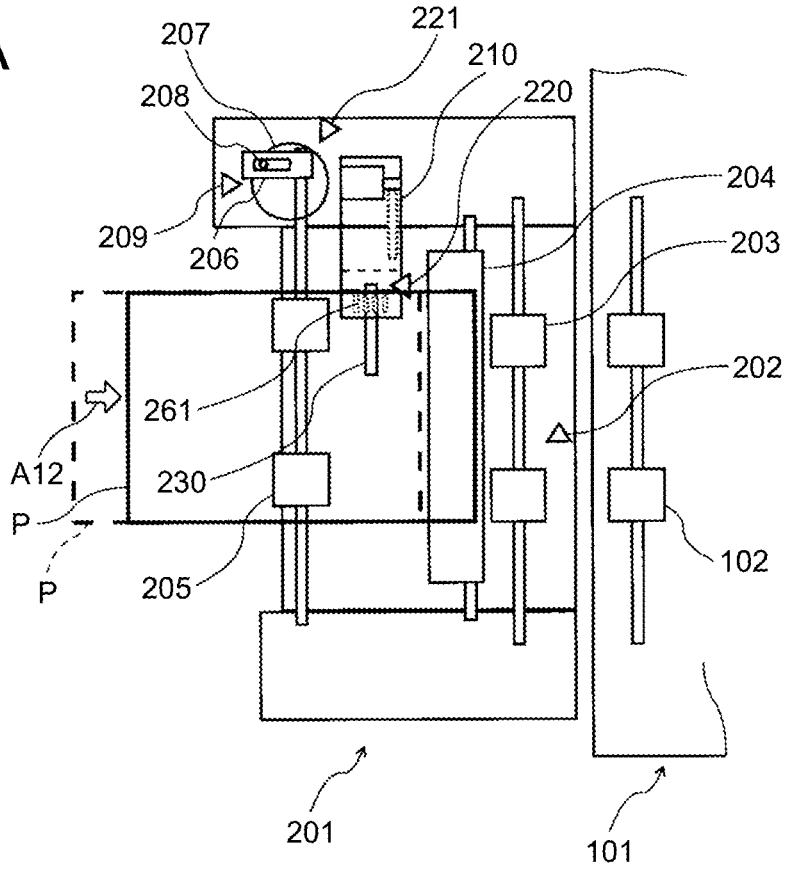
FIGS. 12A and 12B are a plan view and a front view that illustrate the internal state of the sheet post-processing apparatus when the position of the trailing edge of the sheet is set.
Figure 12B:
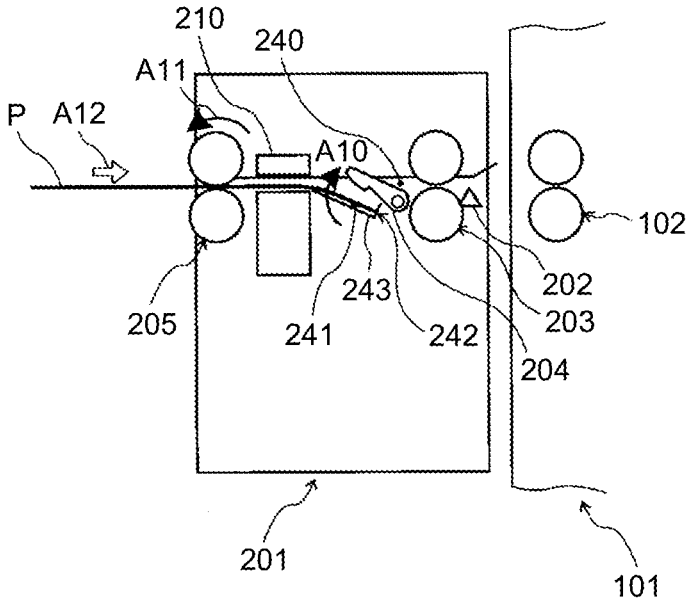

Next, in FIGS. 12A and 12B, the bifurcating claw 204 is rotated in the direction (clockwise direction) of the arrow A10 in FIG. 12B so that the conveyance path is switched. Afterward, the sheet discharge roller 205 is rotated in the reverse direction (counterclockwise direction) of the arrow A11 in the drawing, and the sheet P is conveyed in the arrow A12 in the drawing so that the trailing end section of the sheet P is conveyed to the bifurcating path 241. Due to this conveyance, the sheet P is brought into contact with the contact surface 242 of the fastening-operation tray 243 for alignment, and the sheet discharge roller 205 is stopped. Here, the conveying force of the sheet discharge roller 205 is set to be low so that, when the sheet P is brought into contact, it slips.

Figure 13A:
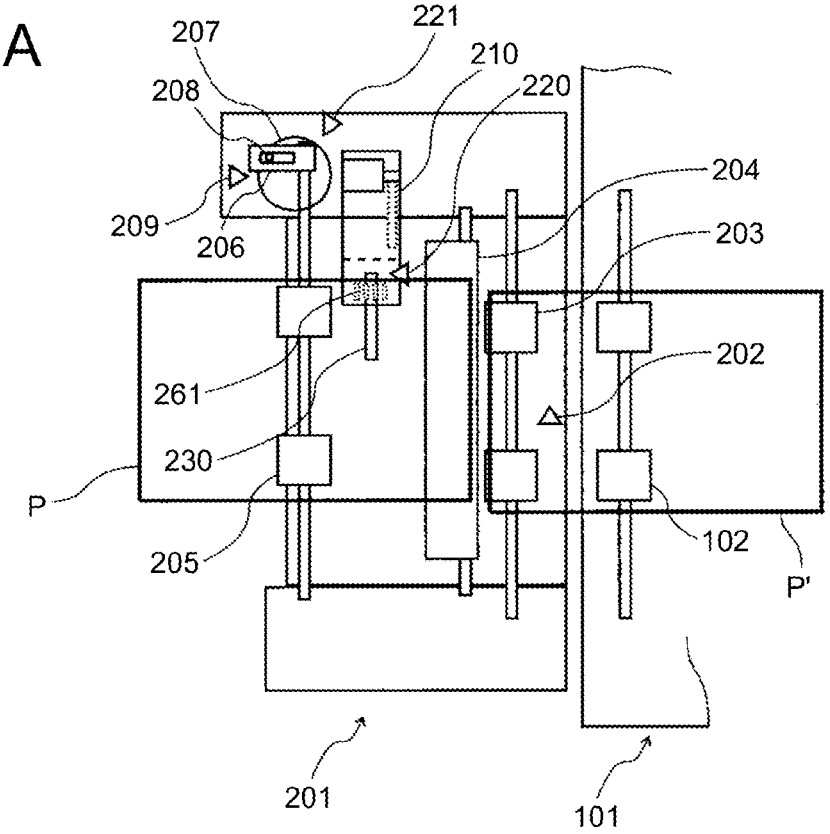
FIGS. 13A and 13B are a plan view and a front view that illustrate the internal state of the sheet post-processing apparatus when the subsequent sheet is received.
Figure 13B:
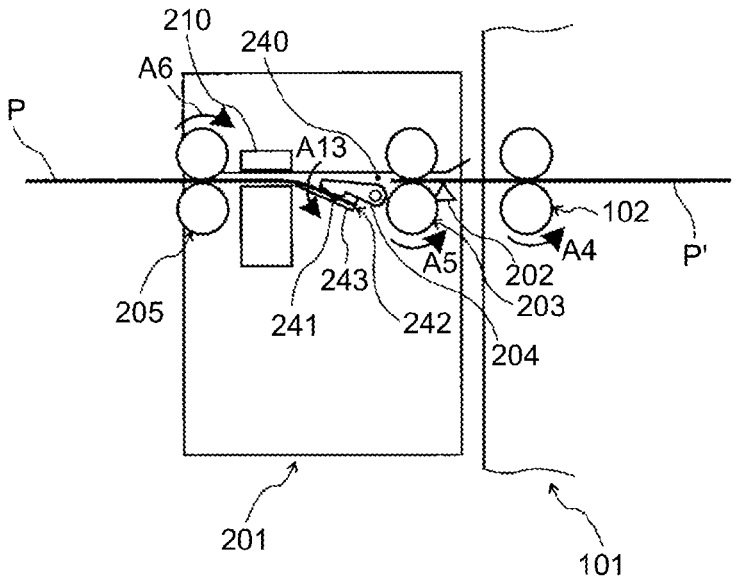

Next, in FIGS. 13A and 13B, the bifurcating claw 204 is rotated in the direction (counterclockwise direction) of the arrow A13 in FIG. 13B, and the trailing edge of the sheet P within the bifurcating path 241 is strongly pressed against the contact surface of the bifurcating claw 204 for standby. When subsequent sheet P' is output from the image forming apparatus 101, the entry roller 203 performs an operation to correct the skew of the sheet P' in the same manner as for the first sheet P. Furthermore, at the same time as the entry roller 203 starts to rotate, the sheet discharge roller 205 also starts to rotate in the rotation direction (the direction A6 in the drawing) to convey the sheet.

Figure 14A:
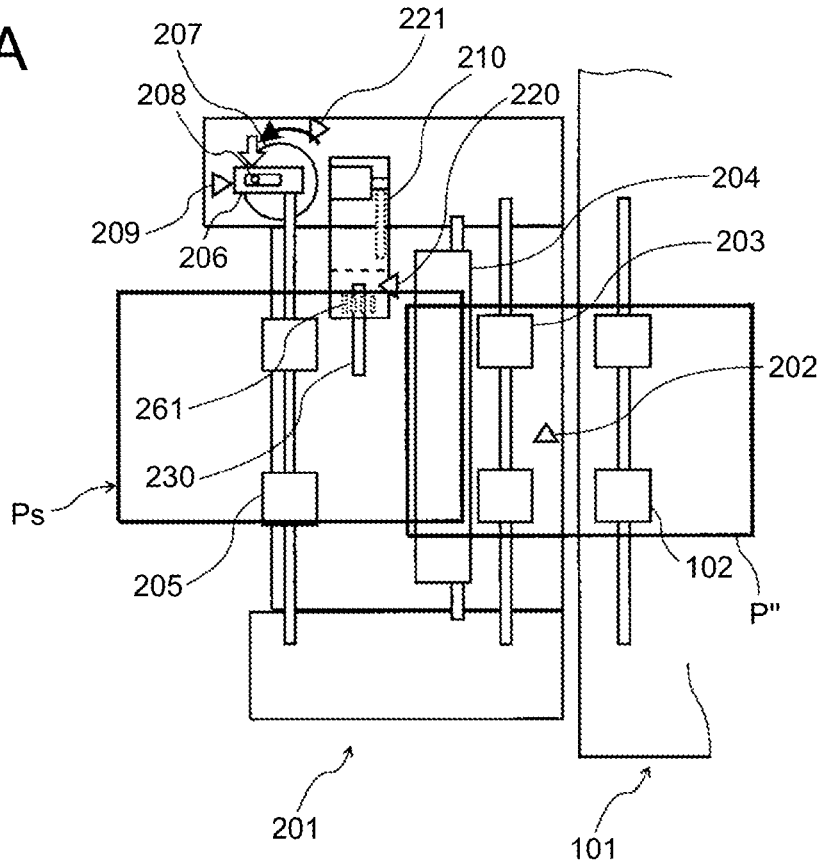
FIGS. 14A and 14B are a plan view and a front view that illustrate the internal state of the sheet post-processing apparatus when another subsequent sheet is received.
Figure 14B:
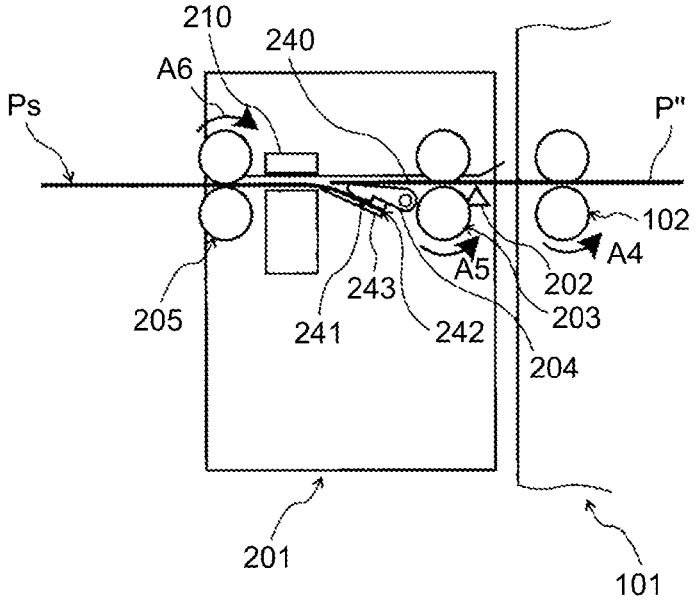

Next, in FIGS. 14A and 14B, the above-described operations of FIGS. 11A to 12B are performed on the second and subsequent sheets P", . . . , and the sheets are sequentially moved to a target position and are stacked, whereby the bundle of aligned sheets Ps is stacked on the conveyance path.

Figure 15A:
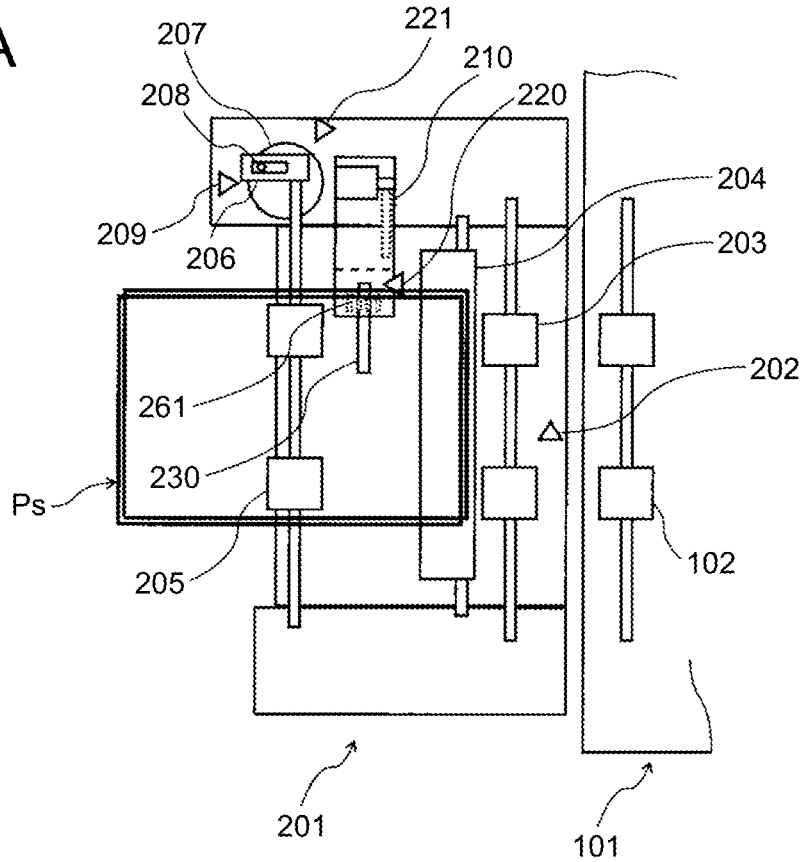
FIGS. 15A and 15B are a plan view and a front view that illustrate the internal state of the sheet post-processing apparatus after an operation to align a bundle of sheets is completed and before a fastening operation is started.
Figure 15B:
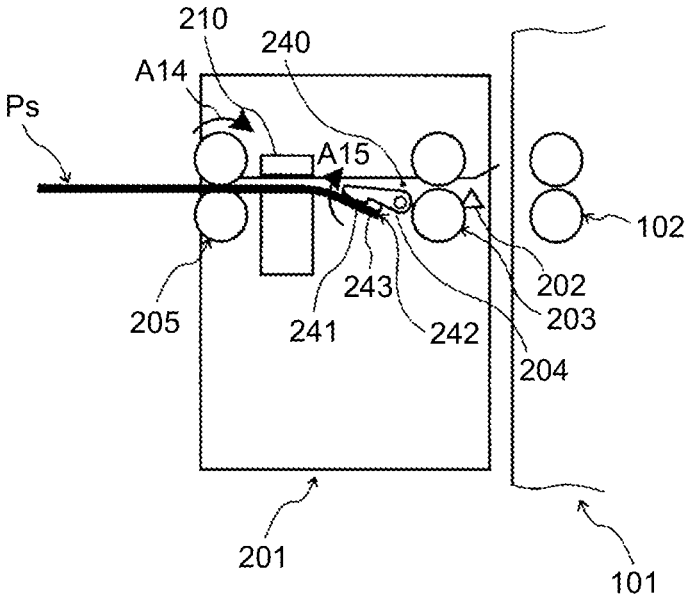

Next, in FIGS. 15A and 15B, an operation is completed to stack the final sheet on the bundle of aligned sheets Ps, the sheet discharge roller 205 is rotated in the direction (clockwise direction) of the arrow A14 of FIG. 15B so that the bundle of sheets Ps is conveyed for a certain distance, and it is then stopped. Due to this operation of the sheet discharge roller 205, it is possible to eliminate the bending that occurs when the trailing edge of a sheet is brought into contact with the contact surface 242. Afterward, the bifurcating claw 204 is rotated in the direction (clockwise direction) of the arrow A15 of FIG. 15B so that the direction of the leading edge thereof is changed, and the pressing force applied to the bundle of sheets Ps is released.

Figure 16A:
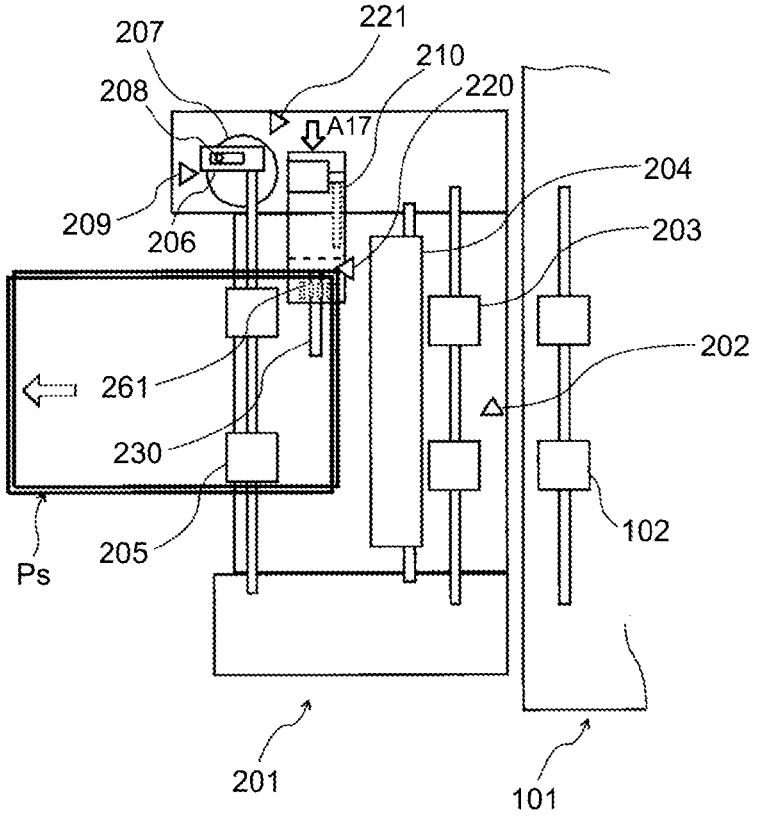
FIGS. 16A and 16B are a plan view and a front view that illustrate the internal state of the sheet post-processing apparatus when the bundle of sheets starts to be discharged after the fastening operation is completed.
Figure 16B:
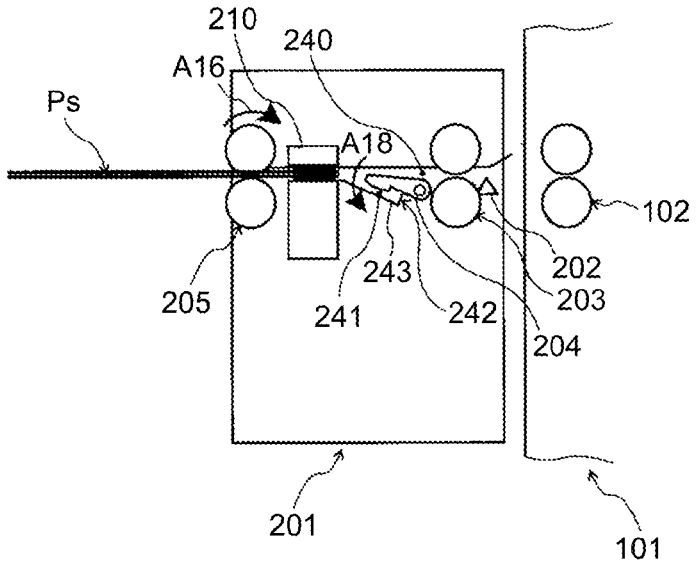

Next, in FIGS. 16A and 16B, the sheet discharge roller 205 is rotated in the direction of the arrow A16 in the drawing, the bundle of sheets Ps is conveyed for a distance such that the position of the teeth 261 of the fastener 210 matches the processing position (fastening position) of sheets, and it is then stopped. Thus, the position of the teeth 261 of the fastener 210 is caused to match the processing position (fastening position) of sheets in the sheet conveying direction. Furthermore, the fastener 210 is moved in the direction of the arrow A17 of FIG. 16A for a distance such that the position of the teeth 261 of the fastener 210 matches the processing position of the sheets, and it is then stopped. Thus, the position of the teeth 261 of the fastener 210 matches the processing position (fastening position) of the sheets in the sheet width direction. At this time, the bifurcating claw 204 is rotated in the direction (counterclockwise direction) of the arrow A18 of FIG. 16B so that the direction of the leading edge thereof is changed, and it enters a state for receiving a sheet. Afterward, the drive motor 265 of the fastener 210 is turned on, and the bundle of sheets Ps is pressed and squeezed by the teeth 261, whereby the fibers of the sheets P are tangled, the sheets are joined, and the bundle of sheets Ps is fastened.

Figure 17A:
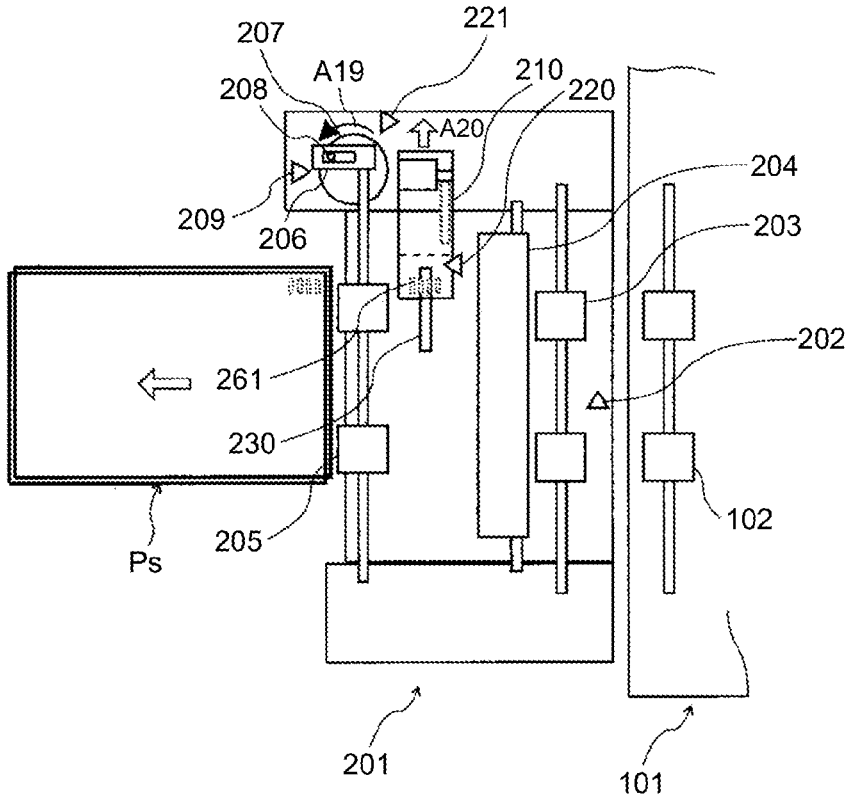
FIGS. 17A and 17B are a plan view and a front view that illustrate the internal state of the sheet post-processing apparatus when the bundle of sheets is being discharged after the fastening operation is completed.
Figure 17B:
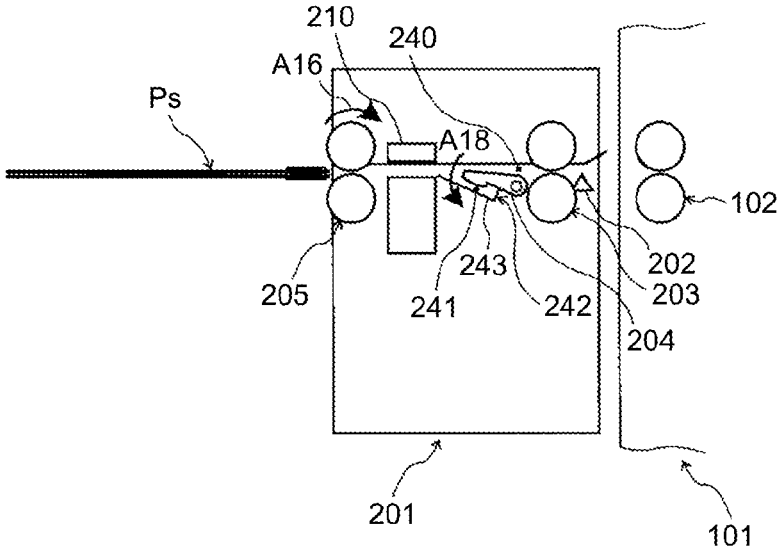

Next, in FIGS. 17A and 17B, when the sheet discharge roller 205 is further rotated in the direction of the arrow A16 in the drawing, the bundle of fastened sheets Ps is discharged. After the bundle of sheets Ps is discharged, the shift cam 207 is rotated in the direction A19 in the drawing to return to the home position, and the fastener 210 is moved in the direction of the arrow A20 in the drawing to return to the home position. As described above, the operation to fasten the bundle of sheets Ps is completed.

Figure 18:
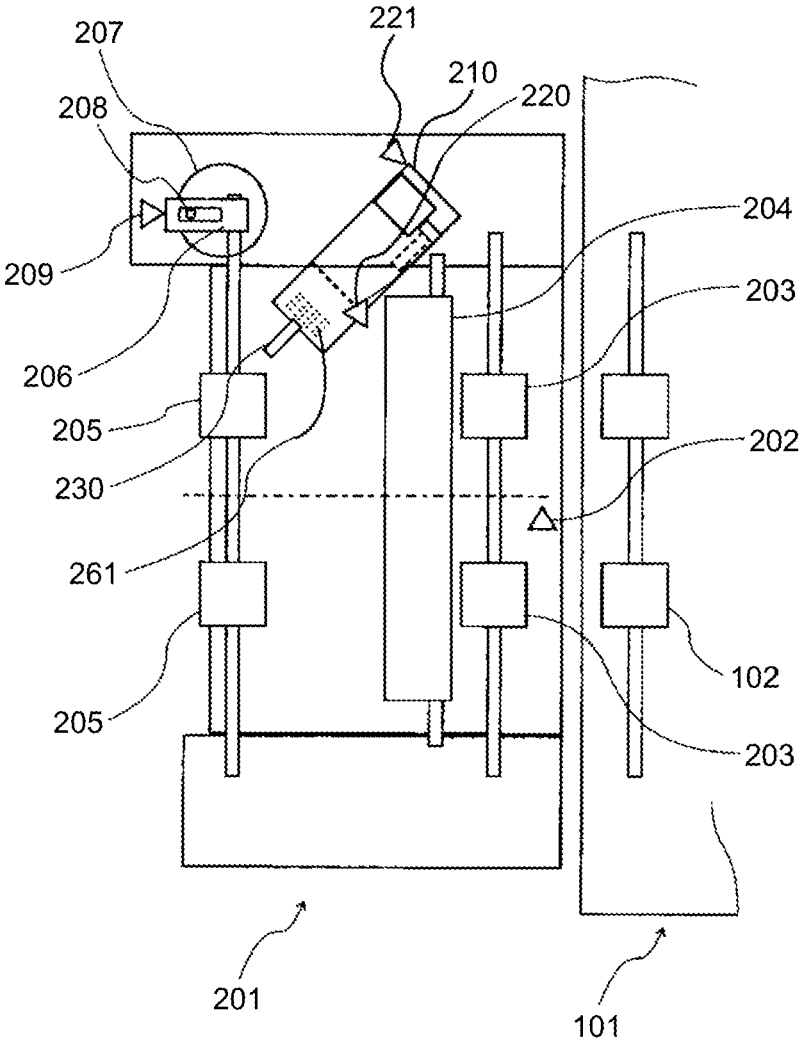
FIG. 18 is a diagram that illustrates a modified example of the sheet post-processing apparatus.

FIG. 18 is a diagram that illustrates a modified example of the sheet post-processing apparatus.

As illustrated in FIG. 18, the fastener 210 may be configured to tilt at 45° relative to the sheet conveying direction and move in a direction tilted at 45° relative to the sheet conveying direction.

Figure 19A:
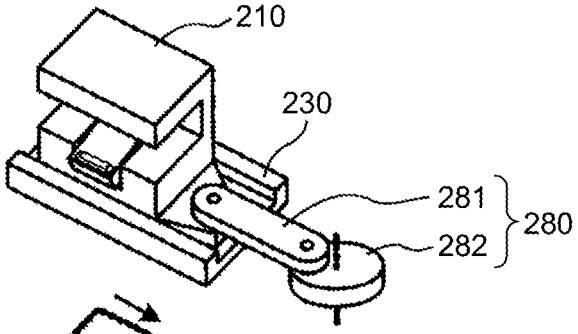
FIGS. 19A and 19B are perspective views that illustrate a moving mechanism that moves the fastener.
Figure 19B:
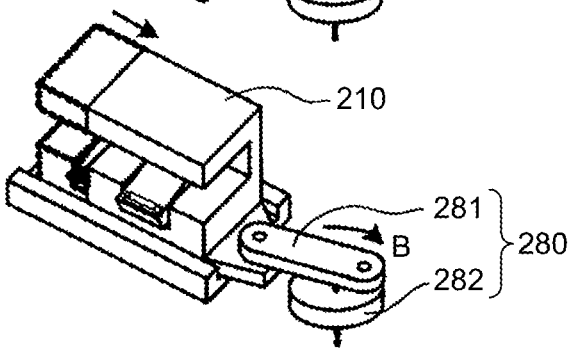

FIGS. 19A and 19B are perspective views that illustrate a moving mechanism 280 that moves the fastener 210. FIG. 19A is a perspective view that illustrates a state where the fastener 210 is in the fastening position, and FIG. 19B is a perspective view that illustrates a state where the fastener 210 is in the home position.

As illustrated in the drawings, the moving mechanism 280 includes an eccentric cam 282 and an arm member 281. One end of the arm member is secured to the eccentric cam 282, and the other end of the arm member is secured to the fastener 210. The fastener 210 is supported such that it can slide and move along the fastener-movement guide rail 230.

When an undepicted moving motor is driven so that the eccentric cam 282 is rotated in the direction of the arrow B in the drawing, the fastener 210 is moved from the fastening position illustrated in FIG. 19A to the home position illustrated in FIG. 19B along the fastener-movement guide rail 230.

Next, the characteristics of the present embodiment are explained.

As explained above with reference to FIGS. 17A and 17B, when a sheet discharge roller 20 is rotated to discharge the bundle of sheets Ps on which the fastening operation has been performed, the teeth 261 are in the position (the position where the sheets are fastened) opposed to the bundle of sheets Ps. After the bundle of sheets Ps is conveyed, the fastener is moved in the direction of the arrow A20 in the drawing to return to the home position. With this configuration, a problem of a conveyance failure occurs. As a result of the inventors' hard study on the problem, the following is proved. A high pressing force is required to strongly nip a bundle of sheets by using the pair of the teeth 261; therefore, the sheet of the bundle, on which pressure fastening has been performed, adheres to the teeth. Thus, it is proved that, while the sheet adheres to a lower tooth 261*b*, the bundle of sheets Ps is conveyed by the sheet discharge roller 20 and therefore the sheet sticks to the lower tooth 261*b* and a conveyance failure occurs.

Therefore, according to the present embodiment, the pair of the teeth 261 is moved from the position opposed to the bundle of sheets Ps to the retracted position that is not opposed to the bundle of sheets Ps and, after the sheet adhering to the teeth is separated, the sheet discharge roller 20 is rotated so that the bundle of sheets Ps is conveyed. A detailed explanation is given below with reference to the drawings.

Figure 20A:
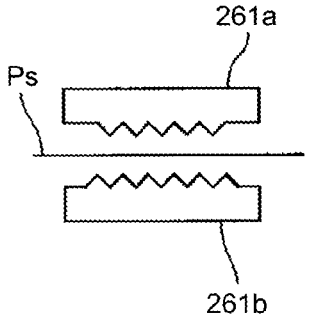
FIGS. 20A to 20D are cross-sectional views that illustrate pressure fastening according to the present embodiment.
Figure 20B:
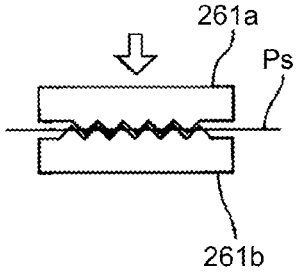
Figure 20C:
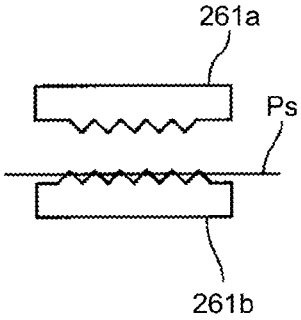
Figure 20D:
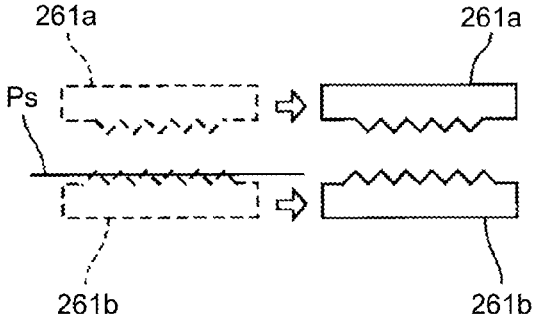
Figure 21A:
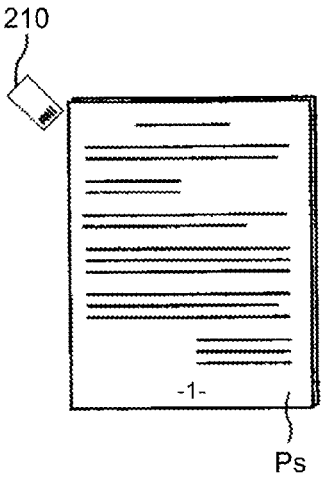
FIGS. 21A to 21C are plan views that illustrate pressure fastening according to the present embodiment.
Figure 21B:
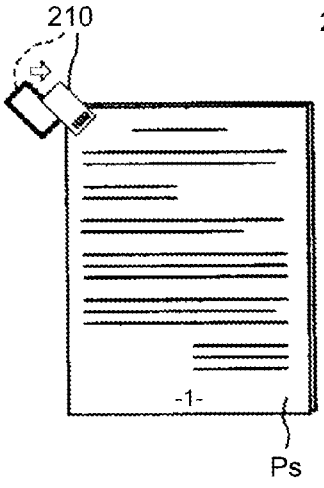
Figure 21C:
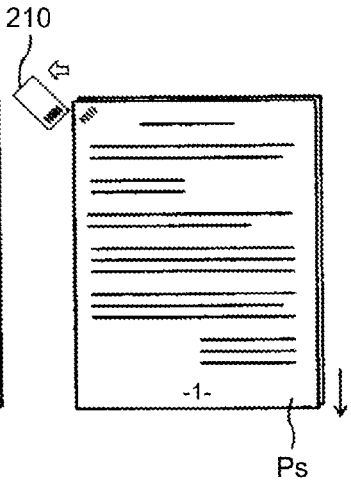
Figure 22:
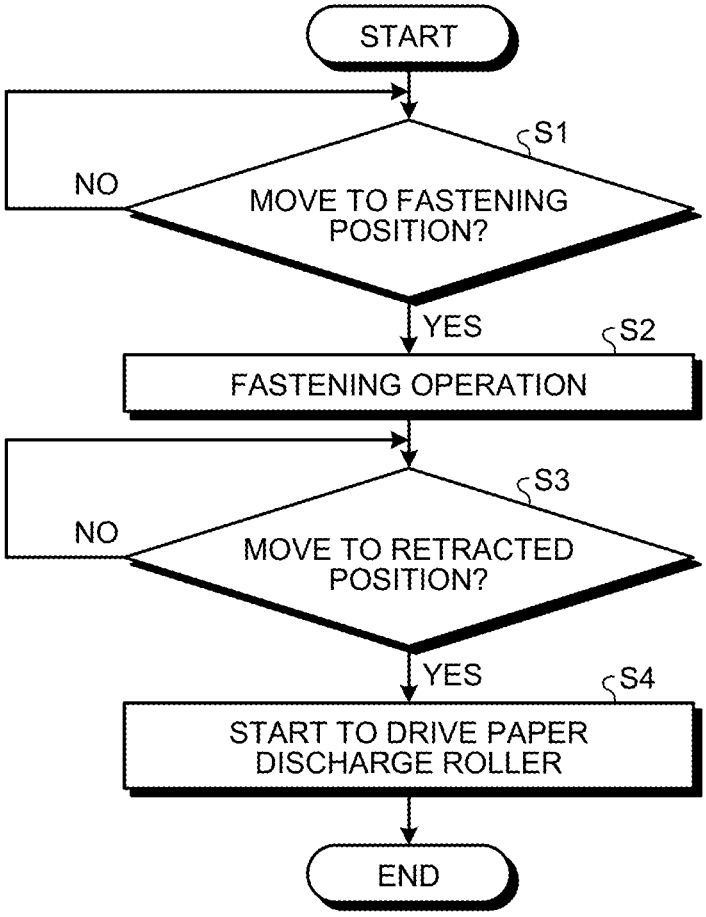
FIG. 22 is a flowchart of a pressure fastening operation.

FIGS. 20A to 20D are cross-sectional views that illustrate pressure fastening according to the present embodiment, and FIGS. 21A to 21C are plan views that illustrate pressure fastening according to the present embodiment. Furthermore, FIG. 22 is a flowchart of a pressure fastening operation.

As illustrated in FIG. 21A, according to the present embodiment, the home position of the fastener 210 is the retracted position where the teeth 261 are not opposed to the bundle of sheets Ps, and the fastener 210 is located in the retracted position except when a fastening operation is performed on the bundle of sheets Ps.

When a fastening operation is performed, the fastener 210 is moved from the retracted position so that the fastener 210 is moved to the fastening position, as illustrated in FIGS. 20A and 21B. As illustrated in the flow of FIG. 22, when the fastener 210 is moved to the fastening position (YES at S1), a fastening operation is performed (S2). Specifically, as illustrated in FIG. 20B, an upper tooth 261*a* is moved, the upper tooth 261*a* and the lower tooth 261*b* are engaged to nip the bundle of sheets Ps, and pressure is applied to the bundle of sheets Ps, whereby the bundle of sheets Ps is fastened. When the fastening operation is completed, the upper tooth 261*a* is moved in a direction away from the bundle of sheets Ps so that the teeth are opened as illustrated in FIG. 20C. At this time, a sheet sometimes adheres to the lower tooth 261*b* that is fixed at a predetermined position. As a high pressing force is required to strongly nip the bundle of sheets by using the pair of the teeth 261, the bundle of sheets on which pressure fastening has been performed adheres to the tooth. Out of the pair of the teeth 261, the upper tooth 261*a* is moved in a direction away from the bundle of sheets Ps after pressure fastening is performed; therefore, a sheet is separated from the upper tooth 261*a* due to the stiffness of the sheet, or the like. Conversely, the lower tooth 261*b* remains at the position after pressure fastening is performed; therefore, after the teeth are opened, a sheet still adheres to the lower tooth 261*b*. If the bundle of sheets Ps is conveyed in the state illustrated in FIG. 20C, there is a possibility that the bundle of sheets Ps sticks to the lower tooth 261*b* while being conveyed and a conveyance failure or damage to a sheet occurs.

Therefore, according to the present embodiment, as illustrated in FIGS. 20D and 21C, the fastener 210 is moved from the fastening position to the retracted position that is the home position (S3). As the fastener 210 is moved to the retracted position, the sheet adhering to the lower tooth 261*b* is separated. When the fastener 210 is moved to the retracted position (YES at S3), the sheet discharge roller 205 starts to be driven (S4) so that the bundle of sheets Ps is conveyed.

Thus, according to the present embodiment, after the fastening operation is performed, an operation is performed to move the pair of teeth to the retracted position so as to separate the sheet that adheres to the teeth and then convey the bundle of sheet. This prevents the bundle of sheets Ps from sticking to the lower tooth 261*b* while being conveyed. Thus, a conveyance failure can be prevented. Furthermore, according to the present embodiment, when the fastener 210 is moved from the fastening position to the retracted position, the bundle of sheets Ps near the fastener 210 is pressed by the pair of the sheet discharge rollers 205. Therefore, the sheet adhering to the lower tooth 261*b* is separated from the teeth 261 without moving to the retracted position together with the fastener 210. Therefore, when the fastener 210 is moved from the fastening position to the retracted position, the sheet adhering to the lower tooth 261*b* is prevented from moving to the retracted position together with the fastener 210, and the occurrence of wrinkles or damages to a sheet can be prevented. Specifically, according to the present embodiment, the pair of the sheet discharge rollers 205 serves as a pressing unit, and the pair of the sheet discharge rollers 205 and the moving mechanism 280 serve as a separating unit that separates a sheet adhering to the lower tooth 261*b*.

Furthermore, the fastener 210 and the sheet discharge rollers 205 are sometimes located away from each other depending on the configuration of the apparatus, for example, in a case of the configuration where a fastening operation is performed on a bundle of sheets on the staple tray 243 that contains sheets that are to be fastened. In this case, there is a possibility that the pressure of the sheet discharge rollers 205 is not sufficiently applied and the sheet adhering to the teeth 261 is moved to the retracted position together with the fastener 210. In such a case, a pressing mechanism may be provided to press a bundle of sheets.

FIGS. 23A to 23G are diagram that illustrate the steps of a sheet post-processing operation by using a provided pressing mechanism 270.

As illustrated in FIGS. 23A to 23G, the pressing mechanism 270 is provided between the fastener 210 and the sheet discharge roller 205. The pressing mechanism 270 includes a pressing member 271, a pressing lever 272, a pressing spring 273, and a pressing solenoid 274.

A pressing section 271*a* that presses the bundle of sheets Ps is provided on an end of the pressing member 271 on the side of the fastener 210 such that the pressing section 271*a* protrudes toward the bundle of sheets Ps. One end of the pressing lever 272 is secured to an end of the pressing member on the side of the sheet discharge roller 205. The pressing lever 272 near its middle section is biased toward the fastener 210 by the pressing spring 273. The other end of the pressing lever 272 is secured to the pressing solenoid 274.

Figure 23A:
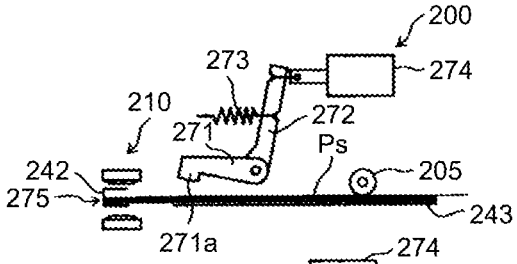
FIGS. 23A to 23G are diagram that illustrate the steps of a sheet post-processing operation by using a provided pressing mechanism.

As illustrated in FIG. 23A, the pressing solenoid 274 is usually on, and the pressing member 271 is located in a pressure released position that is away from the bundle of sheets Ps. Furthermore, with the configuration illustrated in FIGS. 23A to 23G, the fastener 210 is retracted above a stack guide 275 that includes the contact surface 242 of the staple tray 243.

Figure 23B:
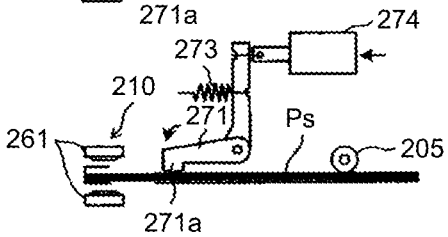

As illustrated in FIG. 23B, when a fastening operation is performed on the bundle of sheets Ps, the pressing solenoid 274 is turned off. Then, the pressing lever 272 is rotated in a counterclockwise direction in the drawing due to the biasing force of the pressing spring 273. Then, the pressing section 271*a* of the pressing member 271 is brought into contact with the bundle of sheets Ps on the staple tray 243 so as to press the bundle of sheets Ps against the staple tray 243.

Figure 23C:
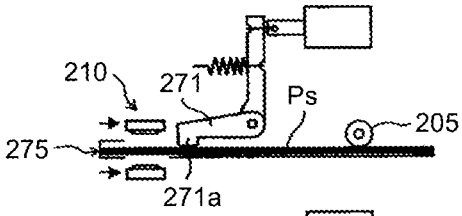
Figure 23D:
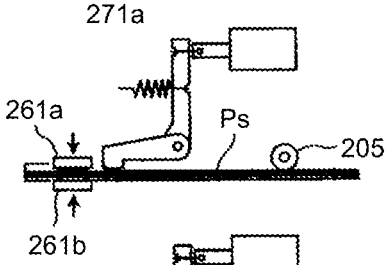

After the bundle of sheets Ps is pressed by the pressing member 271, the fastener 210, which is retracted above the stack guide 275, is moved to the fastening position that is opposed to the bundle of sheets Ps, as illustrated in FIG. 23C. After the fastener 210 is moved to the fastening position, the upper tooth 261*a* and the lower tooth 261*b* of the fastener 210 are engaged to nip the bundle of sheets Ps, pressure is applied to the bundle of sheets Ps, and the bundle of sheets Ps is fastened, as illustrated in FIG. 23D.

Figure 23E:
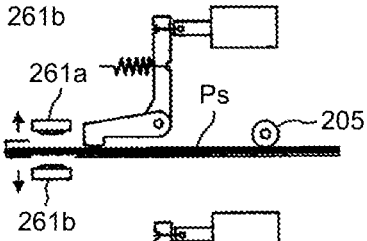
Figure 23F:
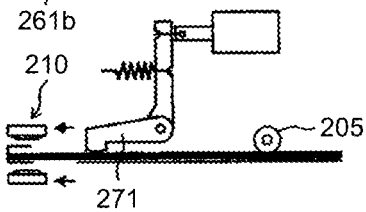

After the bundle of sheets Ps is fastened, the teeth 261*a* and 261*b* are separated from the bundle of sheets Ps, as illustrated in FIG. 23E. Next, as illustrated in FIG. 23F, the fastener 210 is moved to the retracted position above the stack guide 275. At this time, as an area near the fastened area of the bundle of sheets Ps is pressed by the pressing member 271, the sheet adhering to the teeth 261 is separated during the movement of the fastener 210. Thus, the sheet adhering to the teeth 261 is prevented from being moved to the retracted position together with the fastener 210, and the occurrence of wrinkles or damages to a sheet can be prevented.

Figure 23G:
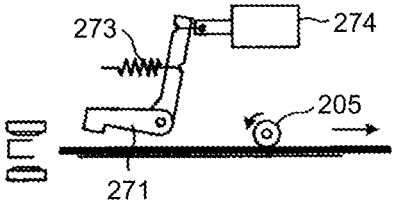

After the fastener 210 is moved to the retracted position, the pressing solenoid is turned on, and the pressing member 271 is rotated in a clockwise direction in the drawing against the biasing force of the pressing spring 273, as illustrated in FIG. 23G. Thus, the pressing member 271 is separated from the bundle of sheets Ps and is moved to the pressure released position, and the pressure to the bundle of sheets Ps is released. After the pressing member 271 is moved to the pressure released position, the sheet discharge roller 205 is rotated in a counterclockwise direction in the drawing to discharge the bundle of sheets Ps that is on the staple tray 243.

In the apparatus illustrated in FIGS. 23A to 23G, the sheet discharge roller 205 is located at a long distance from the trailing end section of the sheet on which fastening has been performed. Therefore, when the sheet discharge roller 205 is driven to rotate so as to convey the bundle of sheets Ps, there is a possibility that the trailing end section of the sheet moves upward or downward in the drawing due to the oscillation that occurs in the apparatus, or the like. At this time, if the fastener 210 is not retracted to the retracted position, there is a possibility that a sheet sticks to the teeth and a conveyance failure occurs. However, according to the present embodiment, the fastener 210 is retracted to the retracted position; therefore, even if the trailing end section of a sheet is bent while the bundle of sheets is conveyed, the sheet can be conveyed without sticking to the teeth. Thus, it is possible to prevent a conveyance failure due to sticking to the teeth.

Figure 24:
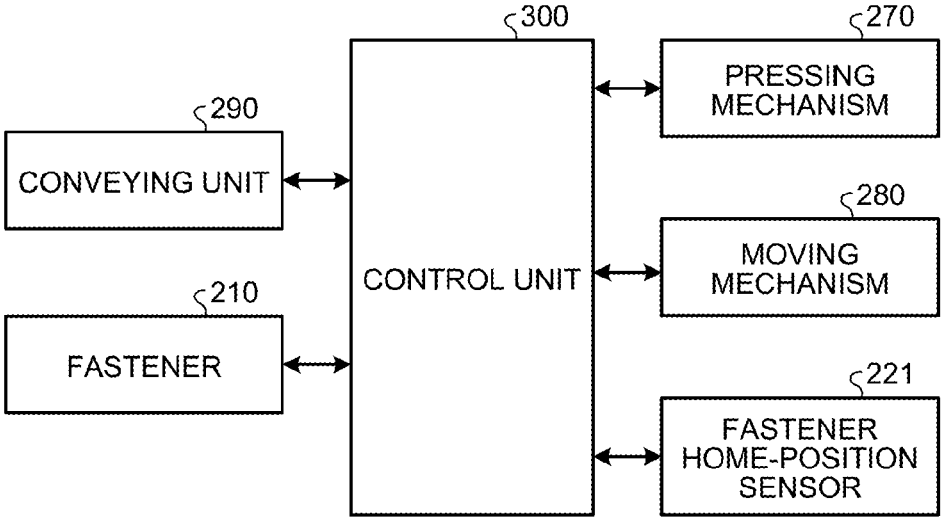
FIG. 24 is a block diagram that illustrates an exemplary configuration of the relevant part of a control system for performing a fastening operation in the sheet post-processing apparatus.

FIG. 24 is a block diagram that illustrates an exemplary configuration of the relevant part of a control system for performing a fastening operation in the sheet post-processing apparatus.

A control unit 300 that is the control unit includes, for example, a CPU, a RAM, a ROM, an I/O interface, or the like. Furthermore, the control unit 300 is connected to, via an undepicted I/O interface, the moving mechanism 280, the pressing mechanism 270, the fastener home-position sensor 221, the fastener 210, a conveying unit 290 that includes, for example, a driving source for driving the sheet discharge rollers 205, or the like. The control unit 300 controls the moving mechanism 280, the pressing mechanism 270, the fastener 210, the conveying unit 290, or the like, on the basis of a program that is stored in the ROM, or the like, so as to perform the above-described fastening operation.

Furthermore, in the above explanation, a fastening operation is performed on a single area of the bundle of sheets Ps; however, a fastening operation may be performed on a plurality of areas.

FIGS. 25A to 25D are diagrams that illustrate an operation when a fastening operation is performed on two areas of the bundle of sheets Ps.

Figures 25A, 25B, 25C, 25D:
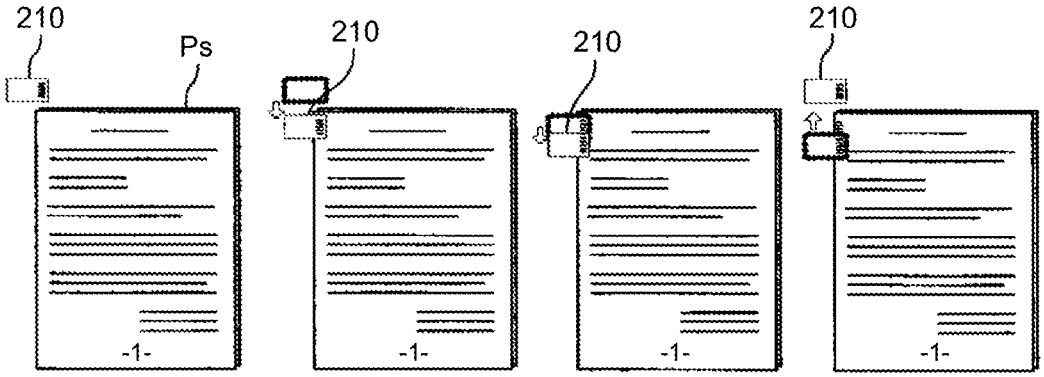
FIGS. 25A to 25D are diagrams that illustrate an operation when a fastening operation is performed on two areas of the bundle of sheets.

As illustrated in FIG. 25A, the fastener 210, which is located in the retracted position, is moved to a first fastening position illustrated in FIG. 25B by the above-described moving mechanism 280. After a fastening operation is performed to fasten the bundle of sheets Ps, the fastener 210 is moved to a second fastening position and a fastening operation is performed, as illustrated in FIG. 25C. After the bundle of sheets Ps is fastened at two areas thereof, the fastener 210 is moved to the retracted position, as illustrated in FIG. 25D. After it is moved to the retracted position, the bundle of sheets Ps is conveyed.

Figure 26A:
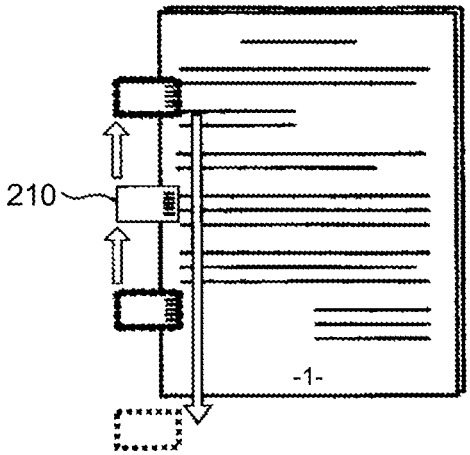
FIGS. 26A and 26B are diagrams that illustrate a modified example when a fastening operation is performed on two areas of the bundle of sheets.
Figure 26B:
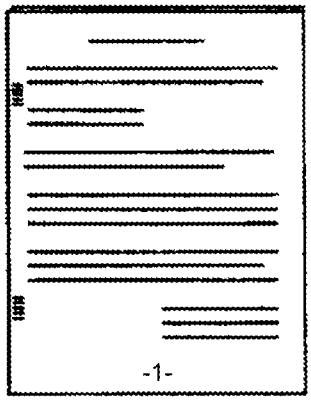
Figure 27A:
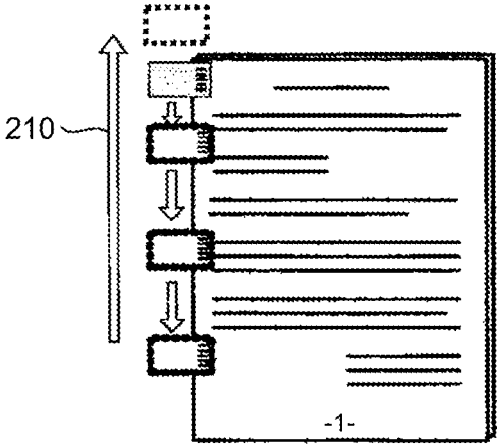
FIGS. 27A and 27B are diagrams that illustrate an operation when a fastening operation is performed on three areas of the bundle of sheets.
Figure 27B:
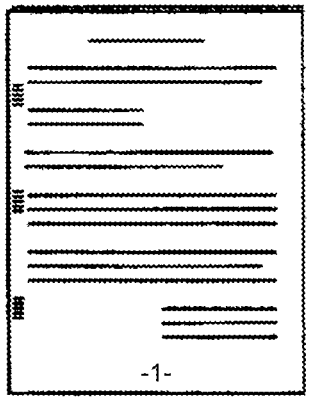

As illustrated in FIGS. 26A and 26B, the first fastening position and the second fastening position may be apart from each other and, as illustrated in FIGS. 27A and 27B, fastening may be applied to three areas. In any case, after a fastening operation is performed on multiple areas, the fastener 210 is returned to the retracted position and the bundle of sheets Ps is conveyed; thus, the bundle of sheets Ps can be conveyed without sticking to the teeth. Furthermore, the position where the fastener initially stands by does not need to be the same as the retracted position.

Figure 28:
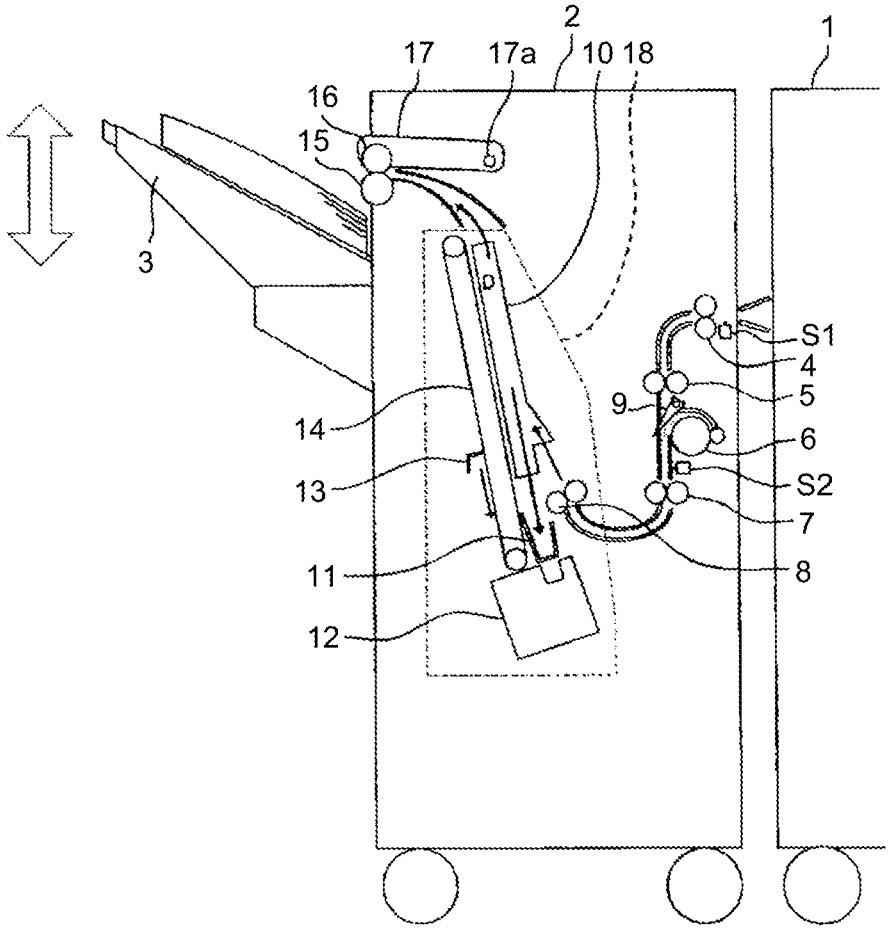
FIG. 28 is a diagram that illustrates a second modified example of the sheet post-processing apparatus.

FIG. 28 is a diagram that illustrates a second modified example of the sheet post-processing apparatus.

As illustrated in FIG. 28, a sheet output from the image forming apparatus 101 is delivered to a sheet post-processing apparatus 201*b* according to the second modified example. After the sheet is delivered to the sheet post-processing apparatus 201*b* according to the second modified example, the sheet is conveyed by a conveyance roller 4 and a conveyance roller 5, is passed through a conveyance path that is obtained by rotating a switch claw 9 due to the moving force of the sheet, and is conveyed to an alignment unit 18 by a conveyance roller 7 and a conveyance roller 8. The conveyed sheet drops due to its own weight in the direction of the arrow B, and it is aligned in a conveying direction by a trailing-edge fence 11. The trailing edge of a sheet is previously detected by a sensor S2 and, after the time during which the sheet can be aligned in the conveying direction, it is aligned in a width direction by an alignment fence 10. This operation is repeatedly performed so that a large number of sheets are aligned one by one.

After alignment of the final sheet is completed, a fastener 12 performs pressure fastening on the bundle of aligned sheets, a release belt 14 in the alignment unit 18 is rotated in the direction of the arrow C, and the bundle of sheets is released from the alignment unit 18 in the direction of the arrow D by a release claw 13 that is secured to the release belt 14. The bundle of sheets is discharged onto and is stacked on a tray 3 by a discharge roller 15 and a driven roller 16. The tray 3 includes a mechanism that moves up and down in accordance with the number of stacked sheets.

The driven roller 16 is attached to a conveyance guide plate 17, it is configured to rotate around a supporting point 17*a* so that, even if the thickness of a bundle of sheets to be conveyed is changed, the same conveying force can be obtained, and it is configured to press the discharge roller 15 due to the weight of the conveyance guide plate 17. These are the operation performed in the case of a single bundle.

In the case of two or more sets, the image forming apparatus 101 continuously performs copying in a copy interval between the final sheet in the previous set and the first sheet in the subsequent set, which is the same interval as that for the other cases, and sends it to the sheet post-processing apparatus 201*b* according to the second modified example.

An explanation is given of an operation to process the second and subsequent sets with reference to FIGS. 29A, 29B, 29C, and 29D.

Figure 29A:
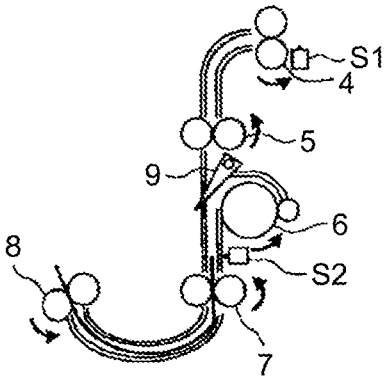
FIGS. 29A to 29D are diagrams that illustrate an operation to process the second and subsequent sets.
Figure 29B:
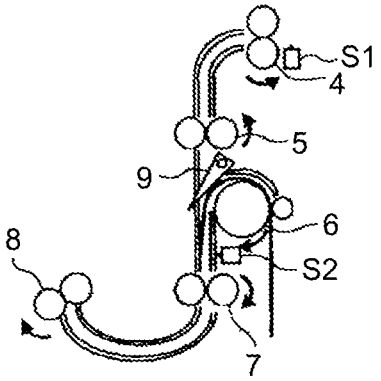

The conveyance rollers 4 and 5 are rotated in the direction of the arrows in FIG. 29A so that the first sheet in the second set is conveyed. If the sensor S2 detects the trailing edge of the sheet and if the alignment unit 18 is not in a state for receiving the sheet, a conveyance roller 6 and the conveyance rollers 7 and 8 are rotated in reverse in the direction of the arrows in FIG. 29B. Then, the sheet is conveyed by the switch claw 9 as illustrated in FIG. 29B and, when the sensor S2 detects the edge of the sheet, it is stopped.

Figure 29C:
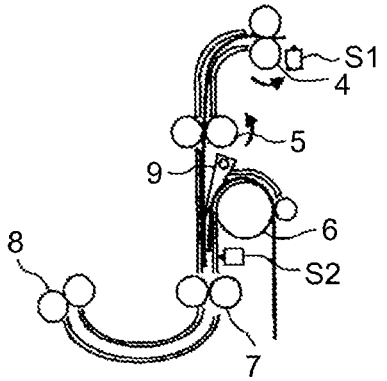
Figure 29D:
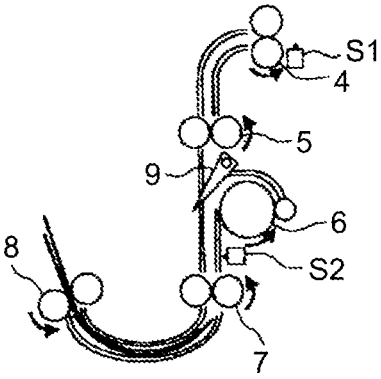

When the second sheet in the second set is conveyed by the conveyance rollers 4 and 5 as illustrated in FIG. 29C and when the sensor S2 detects the leading edge thereof, the conveyance rollers 6, 7, and 8 are rotated in the direction of the arrows of FIG. 29D so that the two sheets are conveyed in a stacked manner. At this time, if the sensor S2 detects the trailing edge of the sheet and if the alignment unit 18 is in a state for receiving the sheet, the sheet is continuously discharged. Conversely, if the alignment unit 18 is not in a state for receiving the sheet, the same operation as that for the first sheet is repeated. Thus, after the same operation as that for the first sheet is repeated on the second and subsequent sheets in the second set until the alignment unit 18 enters a state for receiving the sheet, the two or more sheets are discharged in a stacked manner.

By performing the above operation, post processing can be effectively performed without decreasing the productivity during an operation to staple two or more sets.

Furthermore, in the post-processing apparatus 201*b* according to the second modified example, the same configuration as that of the above-described fastener 210 can be used as the configuration of the fastener 12, whereby the same advantages as that described above can be produced. Moreover, in the post-processing apparatus 201*b* according to the second modified example, after the fastener 12 is moved to the retracted position, a bundle of sheets on which pressure fastening has been performed is conveyed toward the discharge tray 3. Thus, in the post-processing apparatus 201*b* according to the second modified example, a bundle of sheets can be conveyed toward the discharge tray 3 without sticking to the teeth of the fastener 12.

Furthermore, in the above explanation, the fastener is moved by the moving mechanism 280 so that the fastener 210 is moved to the retracted position that is not opposed to the bundle of sheets Ps; however, the bundle of sheets Ps may be moved to retract the fastener 210. Furthermore, both the fastener 210 and a bundle of sheets may be moved to retract the fastener 210 or locate it at the fastening position.

The above explanation is an example, and the present invention produces a specific advantage with respect to each of the following aspects.

Aspect 1

A sheet processing apparatus, such as the sheet post-processing apparatus 201, includes a sheet fastening unit, such as the fastener 210, of a pressing fastener method tin which a bundle of sheets is fastened by using a pair of pressing fastener members, such as the teeth 261; the conveying unit 290 that conveys the bundle of sheets Ps that are fastened by the sheet fastening unit; a separating unit (including the moving mechanism 280, and the like, in the present embodiment) that, after the sheet fastening unit performs a fastening operation on the bundle of sheets, moves both one pressing and the other fastener members, between which the bundle of sheets is interposed, so as to separate a sheet that adheres to the pressing fastener member; and a control unit, such as the control unit 300, that, after the separating unit finishes an operation to separate the sheet, controls the conveying unit 290 so as to convey the bundle of sheets Ps that are fastened by the sheet fastening unit.

According to aspect 1, after the sheet separating unit separates, from the pressing fastener member, the sheet that adheres to the pressing fastener member, a bundle of sheets, such as the bundle of sheets Ps, which are fastened by the sheet fastening unit, such as the fastener 210, is conveyed. Thus, a conveyance failure or damage to sheets can be prevented.

Aspect 2

In (aspect 1), the separating unit includes a moving unit, such as the moving mechanism 280, that moves a pair of the pressing fastener members, such as the teeth 261, relative to the bundle of sheets from a fastening position at which the bundle of sheets is fastened, to a retracted position and, after the pair of pressing fastener members is moved to the retracted position, the control unit, such as the control unit 300, controls the conveying unit 290 so as to convey the bundle of sheets that are fastened by the sheet fastening unit, such as the fastener 210.

According to aspect 2, the sheet that adheres to the pressing fastener member can be separated by moving the pair of pressing fastener members, such as the teeth 261, to the retracted position. Furthermore, during a conveyance of the bundle of sheets, such as the bundle of sheets Ps, that are fastened by the sheet fastening unit, such as the fastener 210, the pair of pressing fastener members, such as the teeth 261, is located in the retracted position. Thus, during a conveyance of the bundle of sheets on which a fastening operation has been performed, the bundle of sheets can be conveyed without sticking to the pressing fastener member.

Aspect 3

In (aspect 2), the separating unit includes a pressing unit, such as the pressing mechanism 270, that presses the bundle of sheets, the moving unit, such as the moving mechanism 280, moves the pair of pressing fastener members, such as the teeth 261, parallel to a surface of the sheet, and the moving unit moves the pair of pressing fastener members while the pressing unit presses the bundle of sheets.

According to aspect 3, when the pair of pressing fastener members, such as the teeth 261, is moved to the retracted positional relation, the sheet adhering to the pressing fastener member can be separated from the pressing fastener member without being moved together with the pressing fastener member. Thus, sheets can be prevented from being bent or damaged.

Aspect 4

In (aspect 3), the moving unit, such as the moving mechanism 280, is configured such that the fastening unit, such as the fastener 210, is capable of fastening the bundle of sheets, such as the bundle of sheets Ps at multiple locations of the bundle of sheets.

With this configuration, a fastening operation can be performed on a bundle of sheets at multiple locations by simply moving the moving unit, such as the fastener.

Aspect 5

An image forming system includes the image forming apparatus 101 that forms an image on a sheet, such as a sheet of paper; and a sheet processing unit, such as the sheet post-processing apparatus 201, that processes a sheet that has an image formed by the image forming apparatus 101, and the sheet processing unit is the sheet processing apparatus according to any one of (aspect 1) to (aspect 4).

With this configuration, the occurrence of a conveyance failure can be prevented.

Aspect 6

An image forming apparatus forms an image on a sheet, such as a sheet of paper, and it includes the sheet processing apparatus according to any one of (aspect 1) to (aspect 4) as a sheet processing unit that processes a sheet with an image formed thereon.

With this configuration, the occurrence of a conveyance failure can be prevented.

According to an embodiment, after a sheet separating unit separates, from a pressing fastener member, a sheet that adheres to the pressing fastener member, a bundle of sheets that are fastened by a sheet fastening unit is conveyed. Thus, a conveyance failure or damage to a sheet can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein the separator includes a moving mechanism, the moving mechanism includes an eccentric cam and an arm member, one end of the arm member is secured to the eccentric cam, and the other end of the arm member is secured to the sheet fastener, and wherein when the eccentric cam is rotated in one direction, the sheet fastener is moved to a fastening position, and when the eccentric cam is rotated in other direction, the sheet fastener is moved to a home position.

2. The sheet processing apparatus according to claim 1, wherein after the pair of pressing fastener members is moved to a retracted position, the controller controls the conveying member so as to convey the bundle of sheets that are fastened by the sheet fastener.

3. The sheet processing apparatus according to claim 2, wherein the separator includes a pressing member that presses the bundle of sheets, the moving mechanism moves the pair of pressing fastener members parallel to a surface of the sheet, and the moving mechanism moves the pair of pressing fastener members while the pressing member presses the bundle of sheets.

4. The sheet processing apparatus according to claim 3, wherein the moving mechanism configured such that the sheet fastener is capable of fastening the bundle of sheets at multiple locations of the bundle of sheets.

5. The sheet processing apparatus according to claim 1, wherein the pressing mechanism includes a pressing member, a pressing lever, a pressing spring, and a pressing solenoid.

6. The sheet processing apparatus according to claim 5, wherein a pressing section that presses the bundle of sheets is provided on an end of the pressing member on the side of the sheet fastener such that the pressing section protrudes toward the bundle of sheets.

7. The sheet processing apparatus according to claim 5, wherein one end of the pressing lever is secured to an end of the pressing member on the side of a sheet discharge roller.

8. The sheet processing apparatus according to claim 5, wherein the pressing lever near its middle section is biased toward the sheet fastener by the pressing spring, and the other end of the pressing lever is secured to the pressing solenoid.

9. The sheet processing apparatus according to claim 5, wherein when the pressing solenoid is ON, the pressing member is located in a pressure released position that is away from the bundle of sheets.

10. The sheet processing apparatus according to claim 5, wherein when the pressing solenoid is OFF, the pressing member is brought into contact with the bundle of sheets on a staple tray so as to press the bundle of sheets against the staple tray.

11. An image forming system comprising:

an image forming apparatus that forms an image on a sheet; and a sheet processor that processes a sheet that has an image formed by the image forming apparatus, wherein the sheet processor including:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein the separator includes a moving mechanism, the moving mechanism includes an eccentric cam and an arm member, one end of the arm member is secured to the eccentric cam, and the other end of the arm member is secured to the sheet fastener, and wherein when the eccentric cam is rotated in one direction, the sheet fastener is moved to a fastening position, and when the eccentric cam is rotated in other direction, the sheet fastener is moved to a home position.

12. An image forming apparatus that forms an image on a sheet, the image forming apparatus comprising a sheet processing apparatus, wherein the sheet processor including:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein the separator includes a moving mechanism, the moving mechanism includes an eccentric cam and an arm member, one end of the arm member is secured to the eccentric cam, and the other end of the arm member is secured to the sheet fastener, and wherein when the eccentric cam is rotated in one direction, the sheet fastener is moved to a fastening position, and when the eccentric cam is rotated in other direction, the sheet fastener is moved to a home position.

13. A sheet processing apparatus comprising:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein:

the separator includes a moving mechanism, the moving mechanism includes an eccentric cam and an arm member, when the eccentric cam is rotated in one direction, the sheet fastener is moved to a fastening position, and when the eccentric cam is rotated in other direction, the sheet fastener is moved to a home position, after the pair of pressing fastener members is moved to the retracted position, the controller controls the conveying member so as to convey the bundle of sheets that are fastened by the sheet fastener, the separator includes a pressing member that presses the bundle of sheets, the moving mechanism moves the pair of pressing fastener members parallel to a surface of the sheet, and the moving mechanism moves the pair of pressing fastener members while the pressing member presses the bundle of sheets.

14. The sheet processing apparatus according to claim 13, wherein the moving mechanism is configured such that the sheet fastener is capable of fastening the bundle of sheets at multiple locations of the bundle of sheets.

15. The sheet processing apparatus according to claim 13, wherein the pressing mechanism includes a pressing member, a pressing lever, a pressing spring, and a pressing solenoid.

16. An image forming system comprising:

an image forming apparatus that forms an image on a sheet; and a sheet processor that processes a sheet that has an image formed by the image forming apparatus, wherein the sheet processor including:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein:

the separator includes a moving mechanism, the moving mechanism includes an eccentric cam and an arm member, when the eccentric cam is rotated in one direction, the sheet fastener is moved to a fastening position, and when the eccentric cam is rotated in other direction, the sheet fastener is moved to a home position, after the pair of pressing fastener members is moved to the retracted position, the controller controls the conveying member so as to convey the bundle of sheets that are fastened by the sheet fastener, the separator includes a pressing member that presses the bundle of sheets, the moving mechanism moves the pair of pressing fastener members parallel to a surface of the sheet, and the moving mechanism moves the pair of pressing fastener members while the pressing member presses the bundle of sheets.

17. The sheet processing apparatus according to claim 16, wherein the moving mechanism is configured such that the sheet fastener is capable of fastening the bundle of sheets at multiple locations of the bundle of sheets.

18. An image forming apparatus that forms an image on a sheet, the image forming apparatus comprising a sheet processing apparatus, wherein the sheet processor including:

a sheet fastener in which a bundle of sheets is fastened by using a pair of pressing fastener members;

a conveying member that conveys the bundle of sheets that are fastened by the sheet fastener;

a separator that, after the sheet fastener performs a fastening operation on the bundle of sheets, moves both of the pressing fastener members, between which the bundle of sheets is interposed, so as to separate a sheet that adheres to the pressing fastener member via a pressing mechanism positioned near an area of the fastened bundle of sheets; and a controller that, after the separator finishes an operation to separate the sheet, controls the conveying member so as to convey the bundle of sheets that are fastened by the sheet fastener, wherein:

the separator includes a moving mechanism, the moving mechanism includes an eccentric cam and an arm member, and when the eccentric cam is rotated in one direction, the sheet fastener is moved to a fastening position, and when the eccentric cam is rotated in other direction, the sheet fastener is moved to a home position, after the pair of pressing fastener members is moved to the retracted position, the controller controls the conveying member so as to convey the bundle of sheets that are fastened by the sheet fastener, the separator includes a pressing member that presses the bundle of sheets, the moving mechanism moves the pair of pressing fastener members parallel to a surface of the sheet, and the moving mechanism moves the pair of pressing fastener members while the pressing member presses the bundle of sheets.

19. The sheet processing apparatus according to claim 18, wherein the moving mechanism is configured such that the sheet fastener is capable of fastening the bundle of sheets at multiple locations of the bundle of sheets.

20. The sheet processing apparatus according to claim 18, wherein the pressing mechanism includes a pressing member, a pressing lever, a pressing spring, and a pressing solenoid.

* * * * *